US012241234B2

(12) United States Patent
Danguchi

(10) Patent No.: US 12,241,234 B2
(45) Date of Patent: Mar. 4, 2025

(54) WORK MACHINE CONTROL SYSTEM, WORK MACHINE, WORK MACHINE CONTROL METHOD, AND WORK MACHINE CONTROL PROGRAM

(71) Applicant: Yanmar Holdings Co., Ltd., Osaka (JP)

(72) Inventor: Masashi Danguchi, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 100 days.

(21) Appl. No.: 18/118,147

(22) Filed: Mar. 7, 2023

(65) Prior Publication Data

US 2023/0279645 A1 Sep. 7, 2023

(30) Foreign Application Priority Data

Mar. 7, 2022 (JP) ..... 2022-034189
Mar. 7, 2022 (JP) ..... 2022-034190

(51) Int. Cl.
*E02F 9/24* (2006.01)
*E02F 9/26* (2006.01)
*E02F 9/22* (2006.01)

(52) U.S. Cl.
CPC ..... *E02F 9/261* (2013.01); *E02F 9/24* (2013.01); *E02F 9/2228* (2013.01); *E02F 9/2285* (2013.01); *E02F 9/2292* (2013.01); *E02F 9/2296* (2013.01)

(58) Field of Classification Search
None
See application file for complete search history.

(56) References Cited

U.S. PATENT DOCUMENTS

2020/0217049 A1 7/2020 Mizuochi et al.
2023/0104700 A1* 4/2023 Danguchi ..... E02F 9/2285 701/50

FOREIGN PATENT DOCUMENTS

JP 2014181510 A 9/2014

* cited by examiner

*Primary Examiner* — K. Wong
(74) *Attorney, Agent, or Firm* — Chris Mizumoto

(57) ABSTRACT

A work machine control system includes: an acquisition processing unit; a determination processing unit; and an alarm processing unit. The acquisition processing unit acquires a detection result of an object around a machine body of a work machine. The determination processing unit determines whether the work machine is operable or inoperable. The alarm processing unit outputs an alarm. The alarm processing unit prohibits the alarm's outputting when it is determined, after the first situation, that the work machine is operable. Further, the alarm processing unit outputs the alarm under the first situation, and continues the alarm's outputting when it is determined, after the first situation, that the work machine is operable. The first situation is defined as a situation in which the work machine is determined to be inoperable, and in which the detection result meets a given condition.

18 Claims, 9 Drawing Sheets

WORK MACHINE CONTROL SYSTEM, WORK MACHINE, WORK MACHINE CONTROL METHOD, AND WORK MACHINE CONTROL PROGRAM

CROSS-REFERENCE

This application claims foreign priority of JP2022-034189 and JP2022-034190 both filed Mar. 7, 2022, the disclosures of which are hereby incorporated by reference in their entirety.

TECHNICAL FIELD

The present invention relates to a work machine control system, a work machine, a work machine control method, and a work machine control program which are used for the work machine capable of detecting an object around a machine body.

BACKGROUND ART

As a related technology, a work machine control system (work machine peripheral monitoring unit) for determining whether or not a person is present around a work machine (excavator) is known (see, for example, Patent Document 1).

In this work machine control system, when it is determined that a gate lock lever is locked and the work machine is not in a state of being operable (operable), and it is determined that a person is present around the work machine, the human detecting flag value is set to "1" (on), but at this time point, an alarm processing unit (alarm control means) does not output an alarm. Then, when the gate lock lever is unlocked and the work machine is switched to a state of being operable, the work machine control system, if the human detecting flag value is "1", outputs the alarm by the alarm processing unit, regardless of whether or not the person is present around the work machine at that time.

Thus, in the work machine control system according to the related technology, the alarm processing unit, when it is determined that the work machine is inoperable and it is determined that the person is present around the work machine, outputs the alarm when it is determined subsequently that the work machine is operable.

PRIOR ART DOCUMENT

Patent Document

Patent Document 1: Japanese Unexamined Patent Application Publication No. 2014-181509

SUMMARY OF INVENTION

Technical Problem

In the above related technology, even when an operator, recognizing the person present around the work machine, has unlocked the gate lock lever, the alarm is output if the work machine is operable. This makes it likely, for the operator, who is working carefully while paying attention to the person around the work machine, to be led to the deteriorated concentration due to the bothersome alarm and being distracted by the alarm. Further, in the above related technology, the alarm is not output when the gate lock lever is locked; thus, as the case may be, the operator, without recognizing the person present around the work machine, unlocks the gate lock lever, and the work machine moves to the state of being operable. In the above case, for avoiding a sudden and vigorous action of the work machine, for example, the operator needs to carefully operate the work machine.

An object of the present invention is to provide a work machine control system, a work machine, a work machine control method and a work machine control program that easily reduce an operator's deteriorated concentration, as well as the work machine control system, the work machine, the work machine control method and the work machine control program that easily reduce the operator's burden related to an operation.

Solution to Problem

A work machine control system according to a mode of the present invention includes: an acquisition processing unit; a determination processing unit; and an alarm processing unit. The acquisition processing unit acquires a detection result of an object around a machine body of a work machine. The determination processing unit determines whether the work machine is operable or inoperable. The alarm processing unit outputs an alarm. The alarm processing unit prohibits the alarm's outputting when it is determined, after the first situation, that the work machine is operable. Further, the alarm processing unit outputs the alarm under the first situation, and continues the alarm's outputting when it is determined, after the first situation, that the work machine is operable. The first situation is defined as a situation in which the work machine is determined to be inoperable and in which the detection result meets a given condition.

A work machine according to a mode of the present invention, includes: the work machine control system; and the machine body.

A work machine control method according to a mode of the present invention includes: acquiring a detection result of an object around a machine body of a work machine; determining whether the work machine is operable or inoperable; and in a first situation defined as a situation in which the work machine is determined to be inoperable and in which the detection result meets a given condition, prohibiting the alarm's outputting when it is determined, after the first situation, that the work machine is operable. Further, a work machine control method according to a mode of the present invention includes: acquiring a detection result of an object around a machine body of a work machine; determining whether the work machine is operable or inoperable; and in a first situation defined as a situation in which the work machine is determined to be inoperable and in which the detection result meets a given condition, outputting an alarm under the first situation, and continuing the alarm's outputting when it is determined, after the first situation, that the work machine is operable.

A work machine control program according to a mode of the present invention is a program for causing one or more processors to execute the work machine control method.

Advantageous Effects of Invention

The present invention can provide a work machine control system, a work machine, a work machine control method and a work machine control program that easily reduce an operator's deteriorated concentration, as well as the work machine control system, the work machine, the work machine control method and the work machine control program that easily reduce the operator's burden related to an operation.

DESCRIPTION OF EMBODIMENTS

Embodiments of the present invention will be described below with reference to the accompanying drawings. The following embodiments each are an embodied example of the present invention, and are not intended to limit the technical scope of the present invention.

First Embodiment

[1] Overall Configuration

Figure 1:
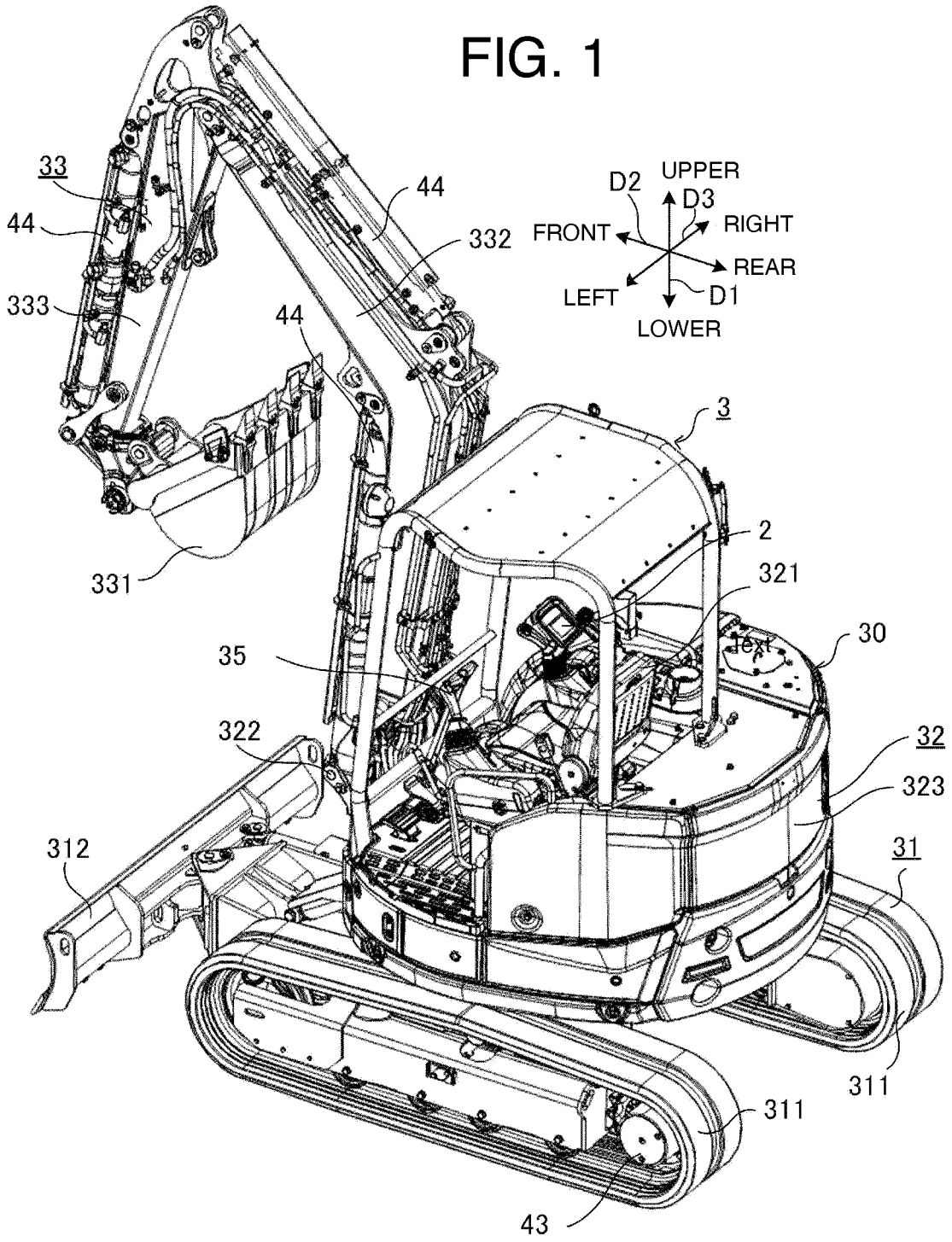
FIG. 1 is a schematic perspective view showing an overall configuration of a work machine according to a first embodiment.
Figure 2:
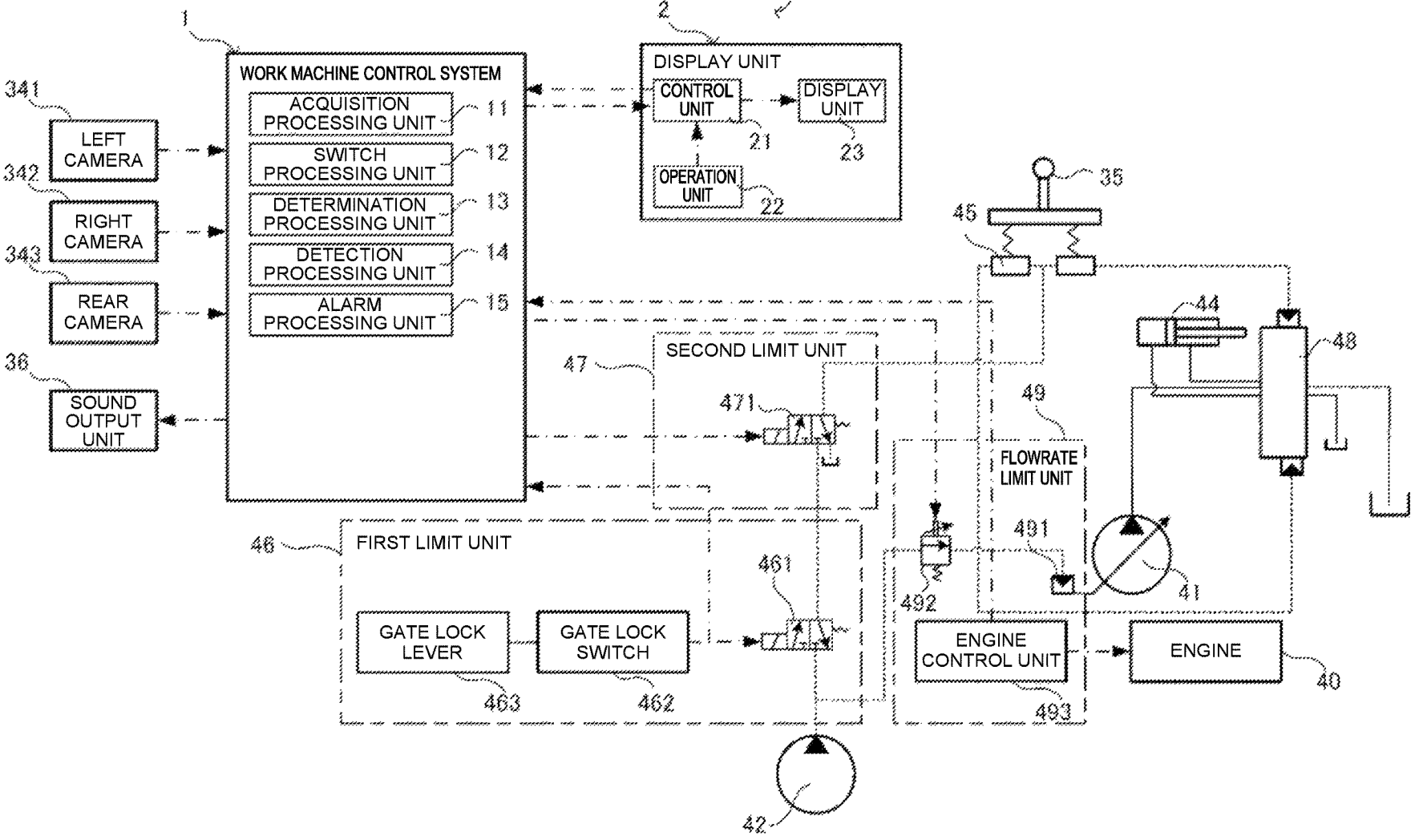
FIG. 2 is a schematic perspective view showing a hydraulic circuit and the like of the work machine according to the first embodiment.

A work machine 3 according to the present embodiment has a machine body 30 provided with a run unit 31, a swing unit 32, and a work unit 33, as shown in FIG. 1. Further, the work machine 3 includes a work machine control system 1 (hereinafter, simply referred to as a "control system 1"), as shown in FIG. 2. Further, the machine body 30, as shown in FIGS. 1 and 2, is provided with a display device 2, a drive unit 34, an operation unit 35 and a sound output unit 36.

In the present embodiment, the control system 1 has, as a primary function thereof, a function to output an alarm in response to a detection result of an object around the machine body 30 of the work machine 3. That is, the control system 1 can be called a peripheral monitoring system for the work machine 3, and the function to control an action of the work machine 3 itself is not essential.

The "work machine" referred to in the present disclosure means a machine for various types of work, examples thereof including work vehicles such as a backhoe (including a hydraulic excavator and a mini excavator), a wheel loader, and a carrier. The work machine 3 is provided with the work unit 33 so configured as to be capable of performing one or more types of work.

The work machine 3 is not limited to the "vehicle", and may also be, for example, a work vessel, or a flying work body such as a drone or a multi-copter. Further, the work machine 3 is not limited to a construction machine (construction equipment), and may also be an agricultural machine (agricultural equipment) such as a rice transplanter, a tractor or a combine harvester. According to the present embodiment, unless particularly specified, a case in which the work machine 3 is a riding-type backhoe and can perform excavating, land preparing, trenching, or loading work as its work will be taken as an example.

Further, according to the present embodiment, for convenience of description, a vertical direction in a state in which the work machine 3 is usable is defined as an up/down direction D1. Further, a front/rear direction D2 and a right/left direction D3 are each defined based on a direction viewed from a user (operator) riding on (a drive unit 321 of) the work machine 3 in a non-swing state of the swing unit 32. In other words, each of the directions used in the present embodiment is a direction defined based on the machine body 30 of the work machine 3, and a direction in which the machine body 30 moves at the time of the work machine 3 moving forward is referred to as "front", and a direction in which the machine body 30 moves at the time of the work machine 3 moving rearward is referred to as "rear". Similarly, a direction in which a front end portion of the machine body 30 moves at the time of the work machine 3 swinging to the right is referred to as "right", and a direction in which the front end portion of the machine body 30 moves at the time of the work machine 3 swinging to the left is referred to as "left". However, these directions are not intended to limit a use direction (a direction in use) of the work machine 3.

The work machine 3 is provided with an engine 40 (see FIG. 2) that serves as a power source. As one example in the present embodiment, the engine 40 is a diesel engine. The engine 40 is driven by a fuel (herein, a light oil) supplied from a fuel tank. In the work machine 3, the engine 40 drives a hydraulic pump 41 (refer to FIG. 2), for example, and a hydraulic oil is supplied from the hydraulic pump 41 to hydraulic actuators (including a hydraulic motor 43, a hydraulic cylinder 44, and the like) of respective portions of the machine body 30 thereby to drive the machine body 30. The above work machine 3 is controlled, for example, by the user (operator), who is riding on the drive unit 321 of the machine body 30, by operating an operation lever and the like of the operation unit 35.

In the present embodiment, it is assumed that the work machine 3 is the riding type backhoe as described above; thus, the work unit 33 is driven according to the operation by the user (operator) riding on the drive unit 321, thereby to perform the work such as excavation. The drive unit 321 on which the user rides is provided at the swing unit 32.

Here, the drive unit 321 of the machine body 30 is provided with the display device 2, the operation unit 35, and the sound output unit 36; the user can operate the operation unit 35 while viewing various types of information that is displayed on the display device 2 and that is related to the work machine 3. As an example, a display screen of the display device 2 displays information on an active state of the work machine 3, such as a cooling water temperature and a hydraulic oil temperature, so that the user can check, by the display device 2, the information that is necessary for operating the operation unit 35 and that is on the active state of the work machine 3.

The run unit 31 has a run function, and is so configured as to be capable of running (including swinging) on the ground. The run unit 31 includes a pair of right and left crawlers 311 and a blade 312, for example. The run unit 31 further includes the run-directed hydraulic motor 43 (hydraulic actuator) for driving the crawler 311.

The swing unit 32 is positioned above the run unit 31, and is so configured as to swing relative to the run unit 31 around a rotation axis along the up/down direction D1. The swing unit 32 has a swing-directed hydraulic motor (a hydraulic actuator). The swing unit 32 includes, other than the drive unit 321, the engine 40 and the hydraulic pump 41. Further, at a front end portion of the swing unit 32, there is provided a boom bracket 322 to which the work unit 33 is mounted.

The work unit 33 is so configured as to perform one or more types of work. The work unit 33 is supported to the boom bracket 322 of the swing unit 32, and performs the work. The work unit 33 has a bucket 331. The bucket 331 is a type of attachment (work instrument) that is mounted on the machine body 30 of the work machine 3, and that is composed of an optional instrument selected from among multiple types of attachments according to content of the work. The bucket 331, as an example, is removably mounted to the machine body 30, and is replaced according to the content of the work. Other than the bucket 331, the attachments for the work machine 3 include various instruments, such as a breaker, an auger, a crusher, a fork, a fork claw, a steel cutter, an asphalt cutter, a mower, a ripper, a mulcher, a tilt rotator, and a tamper.

The work unit 33 further has a boom 332, an arm 333, and a hydraulic actuator (including hydraulic cylinder 44, hydraulic motor, and the like), and the like. The bucket 331 is mounted to a tip of the arm 333.

The boom 332 is rotatably supported by the boom bracket 322 of the swing unit 32. Specifically, the boom 332 is supported by the boom bracket 322 in a mode to rotate about a rotation axis along the horizontal direction. The boom 332 is so shaped as to extend upward from a base end portion supported by the boom bracket 322. The arm 333 is coupled to a tip of the boom 332. The arm 333 is supported to the boom 332 in a mode to rotate about a rotation axis along the horizontal direction.

The work unit 33 moves under power from the engine 40 as the power source. Specifically, the engine 40 drives the hydraulic pump 41 thereby to supply the hydraulic oil from the hydraulic pump 41 to the hydraulic actuator (hydraulic cylinder 44 or the like) of the work unit 33, thereby to move portions (the bucket 331, the boom 332, and the arm 333) of the work unit 33.

According to the present embodiment the work unit 33, in particular, has an articulated configuration in which the boom 332 and the arm 333 are individually rotatable. That is, the boom 332 and the arm 333 each rotate about the rotation axis extending along the horizontal direction, so that the articulated work unit 33 including the boom 332 and the arm 333, for example, is capable of performing operations such as extending and folding as a whole.

Each of the run unit 31 and the swing unit 32, as well as the work unit 33, moves by receiving power from the engine 40 as the power source. That is, the hydraulic oil is supplied from the hydraulic pump 41 to the hydraulic motor 43 of the run unit 31, hydraulic motors of the swing unit 32, and the like, so that the swing unit 32 and the run unit 31 are moved.

Figure 3:
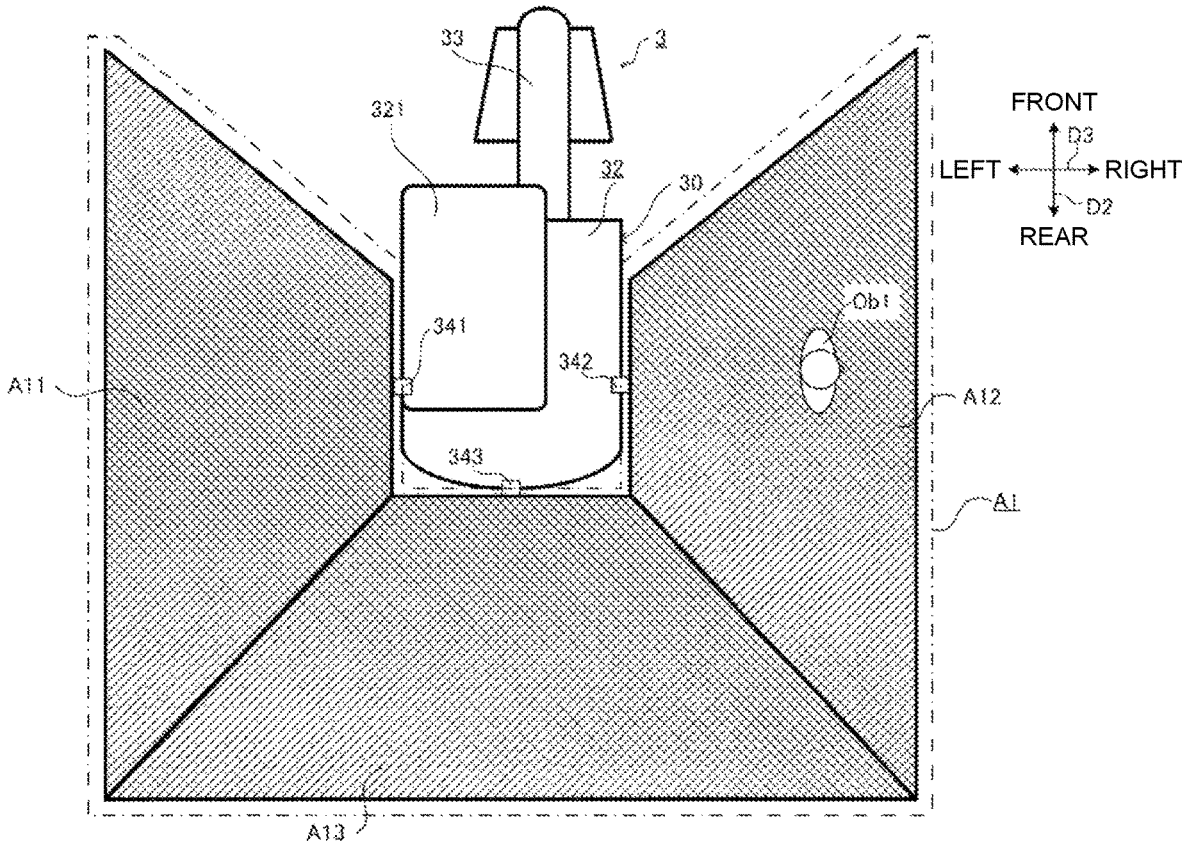
FIG. 3 is a schematic plan view of the work machine according to the first embodiment, viewed from above, schematically showing a monitoring area and the like set around the work machine.

Here, the machine body 30 is provided with various sensors (including cameras) so as to detect an object Ob1 (see FIG. 3) in a monitoring area A1 (see FIG. 3) around the work machine 3, such as a camera to capture an image around the machine body 30. As one example in the present embodiment, as shown in FIG. 3, a multiplicity of cameras (herein, three), including a left camera 341, a right camera 342 and a rear camera 343, are installed on the swing unit 32 of the machine body 30. The left camera 341, the right camera 342 and the rear camera 343 are connected to the control system 1 and output, to the control system 1, an image captured by each of the cameras. FIG. 3 is a plan view of the work machine 3 viewed from above, schematically showing the monitoring area A1 set around the work machine 3, the object Ob1, and the machine body 30 (including the left camera 341, the right camera 342 and the rear camera 343) of the work machine 3.

The left camera 341, the right camera 342, and the rear camera 343 are placed to face left, right, and rear, respectively, based on the drive unit 321, so as to capture images of the monitoring area A1 on left, right, and rear viewed from the operator riding on the drive unit 321 of the swing unit 32. That is, as shown in FIG. 3, the monitoring area A1 includes a multiplicity (here, three) of small areas A11, A12, and A13, and the left camera 341 captures an image of the small area A11 (left area) which is on the left as seen from the operator riding on the drive unit 321. Similarly, the right camera 342 captures an image of the small area A12 (right area) which is on the right as seen from the operator riding on the drive unit 321, and the rear camera 343 captures an image of the small area A13 (rear area) which is in the rear as seen from the operator riding on the drive unit 321. This enables the left camera 341, the right camera 342, and the rear camera 343 to cover the both sides (left and right) and the rear which are often blind spots for the operator.

FIG. 2 schematically shows a hydraulic circuit and electric circuit (electric connection) of the work machine 3 according to the present embodiment. In FIG. 2, a solid line shows a high-pressure oil path (for hydraulic oil), a dotted line shows a low-pressure oil path (for pilot oil), and a dashed-dotted line arrow shows an electric signal path.

As shown in FIG. 2, the work machine 3 has the hydraulic pump 41, the hydraulic motor 43 (omitted from FIG. 2) and the hydraulic cylinder 44, as well as a pilot pump 42, a remote control valve 45, a first limit unit 46, a second limit unit 47, a direction switch valve (control valve) 48, a flowrate limit unit 49, and the like.

The hydraulic oil from the hydraulic pump 41 driven by the engine 40 is supplied to the hydraulic motor 43 of the run unit 31, the hydraulic motor of the swing unit 32, the hydraulic cylinder 44 of the work unit 33, and the like.

This drives the hydraulic actuators such as the hydraulic motor 43 and the hydraulic cylinder 44.

Here, the flowrate of the hydraulic oil supplied from the hydraulic pump 41 is not fixed, and can be changed (variable) by a proper measure. The work machine 3 according to the present embodiment is provided with the flowrate limit unit 49, making it possible to adjust the flowrate of the hydraulic fluid by the flowrate limit unit 49. As one example in the present embodiment, the hydraulic pump 41 includes a variable displacement pump that can change the hydraulic oil flowrate discharged per revolution of a drive shaft.

The flowrate limit unit 49 has a control signal input port 491, a solenoid proportional valve 492, and an engine control unit 493. The control signal input port 491 is a port where a control signal is input so as to adjust the discharge rate (flowrate) of the hydraulic oil of the hydraulic pump 41 composed of the variable displacement type pump. Specifically, a pilot oil which serves as the control signal is supplied from the pilot pump 42 to the control signal input port 491, and the hydraulic oil discharge rate of the hydraulic pump 41 changes according to the supply rate (pilot pressure) of the pilot oil. The solenoid proportional valve 492 is a solenoid proportional control valve provided on the pilot oil's supply path to the control signal input port 491, and adjusts the pilot pressure input to the control signal input port 491. The solenoid proportional valve 492 is connected to the control system 1, and according to the control signal (supply current) from the control system 1, adjusts the pilot pressure input to the control signal input port 491, thereby to change the hydraulic oil discharge rate of the hydraulic pump 41. The engine control unit 493 controls the speed of the engine 40. That is, the engine control unit 493 controls the speed of the hydraulic pump 41, thereby to change the hydraulic oil discharge rate of the hydraulic pump 41.

Thus, the flowrate limit unit 49 controls at least one of the flowrate of the hydraulic pump 41 that supplies the hydraulic oil, the speed of the engine 40 that drives the hydraulic pump 41, and the pilot pressure, thereby making it possible to adjust the flowrate of the hydraulic oil discharged from the hydraulic pump 41. The flowrate limit unit 49 may, without steps, continuously vary the flowrate of the hydraulic fluid discharged from the hydraulic pump 41, or may vary the flowrate at steps (for example, 2, 5, or 10 steps).

Each of the hydraulic actuators, such as the hydraulic motor 43 and the hydraulic cylinder 44, includes a pilot-type direction switch valve 48 capable of switching a direction and flowrate of the hydraulic oil from the hydraulic pump 41. The direction switch valve 48 is driven when the pilot oil serving as an input instruction is supplied from the pilot pump 42.

Here, the remote control valve 45 is provided, for example, in the pilot oil's supply path to the direction switch valve 48 that corresponds to the hydraulic cylinder 44 of the work unit 33. The remote control valve 45 outputs a work operation instruction of the work unit 33 according to the operation of the operation unit 35 (operation lever). The work operation instruction instructs an expanding operation, a contracting operation and the like of the work unit 33. Further, the flowrate of the pilot oil supplied from the pilot pump 42 to the remote control valve 45 is adjustable by the first limit unit 46 and the second limit unit 47. The first limit unit 46 has a first control valve 461, a gate lock switch 462, and a gate lock lever 463. The second limit unit 47 has a second control valve 471.

Further, the first control valve 461 and the second control valve 471 are each a solenoid control valve (electromagnetic valve), and are inserted in series between the remote control valve 45 and the pilot pump 42. The first control valve 461 is connected via the gate lock switch 462 to the power source, and operates according to the current supplied from the power source. The second control valve 471 is connected to the control system 1, and operates according to the control signal (supply current) from the control system 1. The first control valve 461 and the second control valve 471, here, are each assumed to be a (electromagnetic) proportional control valve, but can also be a switchable open/close valve that opens/shuts off the flow path, for example.

The first control valve 461 and the second control valve 471 each in an energized state, that is, when the current as the control signal is supplied, open the flow path of the pilot oil, and in a de-energized state, that is, when the current as the control signal is shut off, shut off the flow path of the pilot oil. Thus, shutting off the supply current (control signal) to at least one of the first control valve 461 and the second control valve 471 disenables the hydraulic actuator (hydraulic cylinder 44 and the like) that corresponds to the remote control valve 45, thus forcibly stopping the hydraulic actuator not depending on the operation of the operation unit 35.

Similarly, a remote control valve is also provided in the pilot oil's supply path to a direction switch valve that corresponds to the hydraulic motor 43 of the run unit 31. This remote control valve outputs a run operation instruction of the run unit 31 according to the operation of the operation unit 35 (operation lever). The run operation instruction instructs a run action (for example, forward or backward) of the run unit 31. Further, a remote control valve is also provided in the pilot oil's supply path to a direction switch valve that corresponds to the hydraulic motor of the swing unit 32. This remote control valve outputs a swing operation instruction of the swing unit 32 according to the operation of the operation unit 35 (operation lever). The swing operation instruction instructs a swing action (for example, left swing or right swing) of the swing unit 32. And, to between these remote control valves and the pilot pump 42, the first control valve 461 and the second control valve 471 are inserted.

The gate lock switch 462 is interlocked with the gate lock lever 463. The gate lock lever 463 is placed at the drive unit 321 of the machine body 30, and receives an operation input by the user (operator). As one example in the present embodiment, the gate lock lever 463 is operable along the up/down direction D1. When the gate lock lever 463 is in "up position" which is the upper end position of the movable range, the gate lock switch 462 is "off"; when the gate lock lever 463 is in "down position" which is the lower end position of the movable range, the gate lock switch 462 is "on". Then, the gate lock switch 462 is connected to the control system 1, and on/off of the gate lock switch 462 is monitored by the control system 1.

Thus, when the gate lock lever 463 is in "down position", the first control valve 461 is brought in the energized state, driving the hydraulic actuator (hydraulic cylinder 44 and the like) by the operation of the operation unit 35. In contrast, when the gate lock lever 463 is in the "up position", the first control valve 461 is brought in the de-energized state, forcibly stopping the hydraulic actuator not depending on the operation of the operation unit 35. Thus, for driving the hydraulic actuator (such as hydraulic cylinder 44), the user (operator) needs to operate the gate lock lever 463 to "down position".

Further, each of the swing unit 32 and the run unit 31 moves with the hydraulic oil supplied from the hydraulic pump 41 to the hydraulic actuator (hydraulic motor 43 and the like); thus, when the gate lock lever 463 is in the "up position", the swing unit 32 and the run unit 31 also become disenabled. That is, when the gate lock lever 463 is in the "up position", all of the work unit 33, the swing unit 32, and the run unit 31 are forcibly disenabled.

In short, the gate lock switch 462, when being off, is in a "locked state" in which the action of the work machine 3 is limited (including prohibited), and when being on, is in an "unlocked state" in which the action of the work machine 3 is not limited. Then, when the gate lock lever 463 is in "up position" and the gate lock switch 462 is locked (off), the action of the work machine 3 is forcibly limited not depending on the operation of the operation unit 35. The gate lock lever 463 is the lever that is operated for locking the action of the work machine 3, and is synonymous with a cutoff lever.

The operation unit 35 is placed at the drive unit 321 of the machine body 30, and is a user interface for receiving the operation input by the user (operator). The operation unit 35 outputs an electric signal (operation signal) that accords to the operation by the user, for example, thereby to receive various operations by the user.

The sound output unit 36 outputs a sound (including voice) to the user (operator). The sound output unit 36 includes a buzzer or a speaker, and outputs the sound upon receiving the electric signal. The sound output unit 36 is connected to the control system 1, and outputs the sound, such as a beep or a voice, according to a sound control signal from the control system 1. In the present embodiment, the sound output unit 36, as well as the display device 2, is provided in the drive unit 321 of the machine body 30. The sound output unit 36 may be provided integrally with the display device 2.

The control system 1 is mainly configured by a computer system having one or more processors such as a CPU (Central Processing Unit), and one or more memories such as a ROM (Read Only Memory) and a RAM (Random Access Memory), executing various processes (information process). According to the present embodiment, the control system 1 is an integrated control unit that controls the overall work machine 3, and includes, for example, an electronic control unit (ECU).

However, the control system 1 may be provided separate from the integrated control unit, and may be primarily composed of one or more processors. The control system 1 is to be described in detail in the column "[2] Configuration of Control System".

The display device 2 is placed at the drive unit 321 of the machine body 30, and is a user interface for receiving the operation input by the user (operator) and thereby for outputting various types of information to the user. The display device 2 outputs an electric signal that accords to the operation by the user, for example, thereby to receive various operations by the user. With this, the user (operator) can view a display screen Dp1 (refer to FIG. 4) displayed on the display device 2, and also can operate the display device 2 as necessary.

As shown in FIG. 2, the display device 2 includes a control unit 21, an operation unit 22, and a display unit 23. The display device 2 is so configured as to be communicable with the control system 1, and can execute sending and receiving of data to and from the control system 1. As one example in the present embodiment, the display device 2 is a dedicated device used for the work machine 3.

The control unit 21 controls the display device 2 according to the data from the control system 1. Specifically, the control unit 21 outputs the electric signal that accords to the user's operation received by the operation unit 22, and displays, on the display unit 23, the display screen Dp1 generated by the control system 1.

Figure 4:
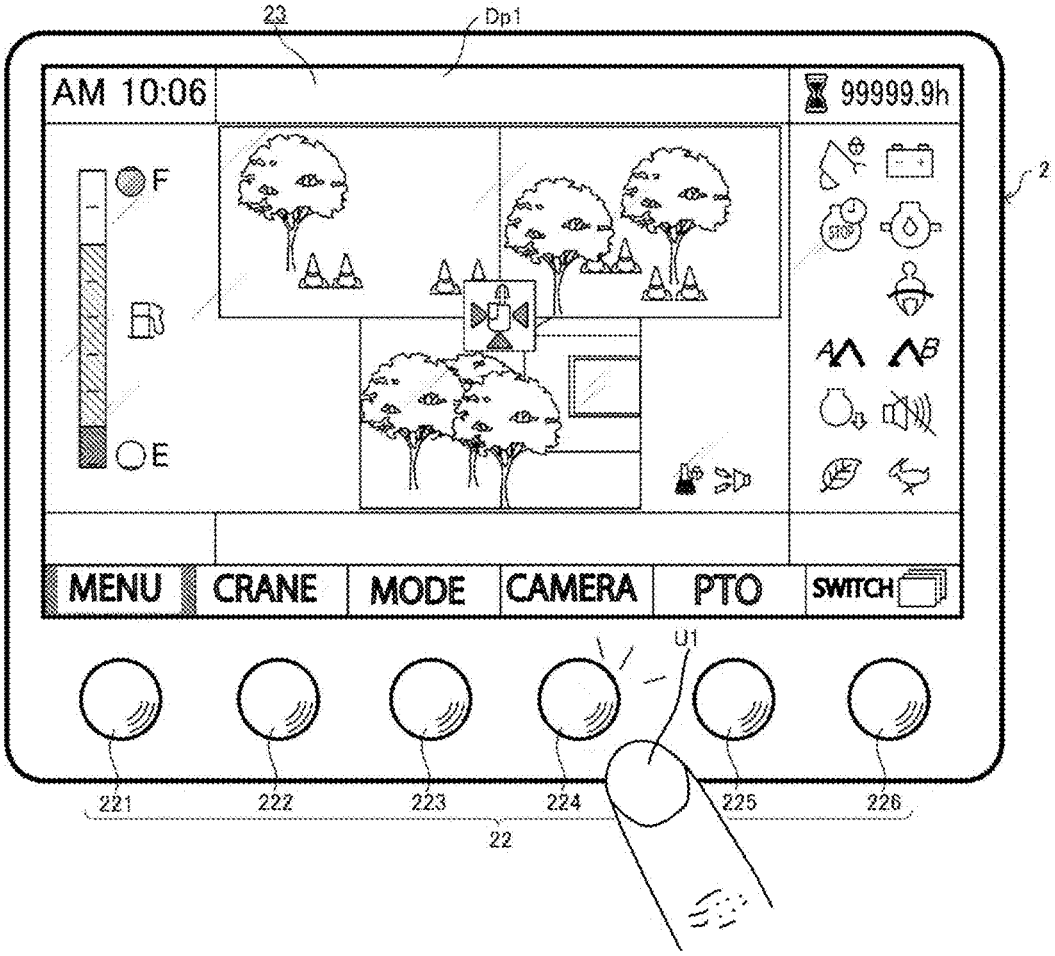
FIG. 4 is a schematic external view of a display device on which a display screen is displayed by a work machine control system according to the first embodiment.

The operation unit 22 is a user interface for receiving the user (operator)'s operation input to the display screen Dp1 displayed on the display unit 23. The operation unit 22 outputs the electric signal that accords to an operation of a user U1 (refer to FIG. 4), for example, thereby to receive various operations by the user U1. As one example in the present embodiment, the operation unit 22 includes multiple (herein six) mechanical push button switches 221 to 226, as shown in FIG. 4. Along a periphery of a display area of the display unit 23, the multiple push button switches 221 to 226 are placed in the vicinity of the display area (a lower portion in the example in FIG. 4). The multiple push button switches 221 to 226 are associated with after-described items displayed on the display screen Dp1; operating any of the multiple push button switches 221 to 226 operates (selects) any of the items on the display screen Dp1.

Further, the operation unit 22 may include a touch screen and an operation dial. In this case as well, it is deemed that operating the operation unit 22 operates (selects) any of the items on the display screen Dp1.

The display unit 23 is a user interface, which is for presenting information to the user U1 (operator), such as a liquid crystal display or organic EL display that displays various types of information. The display unit 23, by display, presents various types of information to the user. As one example in the present embodiment, the display unit 23 is a full-color liquid crystal display with a backlight, and has a "horizontally-long" display area that is long in a horizontal direction, as shown in FIG. 4.

Further, the machine body 30 is provided with a communication terminal, a fuel tank, a battery, and the like, in addition to the above configuration. Further, the machine body 30 is provided with various sensors (including cameras) for detecting a to-be-detected object in a monitoring area around the work machine 3, examples of sensors including a camera for capturing an image around the machine body 30.

[2] Configuration of Control System

Next, a configuration of the control system 1 according to the present embodiment will be described with reference to FIG. 2. The control system 1 controls each portion of the machine body 30 (including the run unit 31, the swing unit 32, and the work unit 33). According to the present embodiment, the control system 1 is a component of the work machine 3, constituting the work machine 3 together with the machine body 30 and the like. In other words, the work machine 3 according to the present embodiment is provided with at least the control system 1 and the machine body 30.

As shown in FIG. 2, the control system 1 is provided with an acquisition processing unit 11, a switch processing unit 12, a determination processing unit 13, a detection processing unit 14, and an alarm processing unit 15. As one example in the present embodiment, the control system 1 is mainly composed of a computer system having one or more processors; thus, the one or more processors, by executing a work machine control program, realize the above multiple functional units (acquisition processing unit 11 and the like). The multiple functional units included in the control system 1 may be distributed to multiple cases, or may be included in a single case.

The control system 1 is so configured as to be communicable with a device provided at each unit of the machine body 30. This means that, to the control system 1, at least the display device 2, the left camera 341, the right camera 342, the rear camera 343, the sound output unit 36, the gate lock switch 462, the second control valve 471, the solenoid proportional valve 492, the engine control unit 493 and the like are connected. This causes the control system 1 to control the display device 2, the sound output unit 36 and the like, and to acquire the images captured by the left camera 341, the right camera 342, the rear camera 343 and the like. Here, the control system 1 may send and receive various types of information (data) directly to and from each device, or indirectly through a relay or the like. The control system 1 can communicate with the device provided at each portion of the machine body 30, by, as an example, a communication method such as a Control unit Area Network (CAN).

The acquisition processing unit 11 executes the acquisition process to acquire the detection result of the object Ob1 around the machine body 30 of the work machine 3. Specifically, according to the present embodiment, the object Ob1 around the machine body 30 is detected by the detection processing unit 14 based on output of the left camera 341, right camera 342, and rear camera 343. Thus, from the detection processing unit 14, the acquisition processing unit 11 acquires the detection result of the object Ob1 around the machine body 30. As one example in the present embodiment, the object Ob1 is a "person". That is, when the "person" enters the monitoring area A1 around the work machine 3 as a result of the work machine 3 having moved or the "person" around the work machine 3 having moved, the detection processing unit 14 detects the "person" as the object Ob1. When multiple objects Ob1 are present in the monitoring area A1, the detection processing unit 14 may perform the detection including the number of objects Ob1 (the number of persons).

That is, regardless of whether the gate lock lever 463 is in "up position" or "down position", the acquisition processing unit 11, from the detection processing unit 14, regularly or irregularly acquires the detection result of the object Ob1 around the machine body 30.

The switch processing unit 12 executes a mode switching process to switch an action mode of the alarm processing unit 15. As one example in the present embodiment; there are prepared, as action modes of the alarm processing unit 15, multiple action modes including a first action mode and a second action mode. The switch processing unit 12 selects one of these multiple action modes, thereby to switch the action mode of the alarm processing unit 15. For example, if the switch processing unit 12 selects the second action mode when the alarm processing unit 15 is in the first action mode, the alarm processing unit 15 switches from in the first action mode to in the second action mode. Similarly, if the switch processing unit 12 selects the first action mode when the alarm processing unit 15 is in the second action mode, the alarm processing unit 15 switches from in the second action mode to in the first action mode.

Here, the switch processing unit 12 switches the action mode of the alarm processing unit 15 in response to the operation by the user (operator). As an example, in a state where the setting screen is displayed as the display screen Dp1 on the display device 2, the user so operates the display device 2 as to select any action mode (first or second action mode) on the setting screen. When the display device 2 receives the above operation, the switch processing unit 12 switches the action mode of the alarm processing unit 15 to any action mode selected by the user. The setting screen displayed on the display device 2 also makes it possible to check the currently selected action mode.

The determination processing unit 13 executes a determining process to determine whether "the work machine 3 is inoperable" or "the work machine 3 is operable". Here, "the work machine 3 is inoperable" means a state in which the work machine 3 is not driven by the operation of the operation unit 35, and includes at least the state in which the gate lock lever 463 is in "up position" and the gate lock switch 462 is off. Further, "the work machine 3 is inoperable" includes, for example, a state in which an ignition of the work machine 3 is off (that is, the engine 40 is stopped), and a state in which the main power source of the work machine 3 is off. Conversely, "the work machine 3 is operable" means a state in which the work machine 3 is driven by the operation of the operation unit 35, and includes at least a state in which the gate lock lever 463 is in "down position" and the gate lock switch 462 is on. Further, "the work machine 3 is operable" includes, for example, a state in which the ignition of the work machine 3 is on (that is, the engine 40 is driving), and the main power source of the work machine 3 is on.

The determination processing unit 13 determines, based on at least the input signal from the gate lock switch 462, whether the gate lock lever 463 is in "up position" or "down position". As one example in the present embodiment, "the work machine 3 is inoperable" is defined as a locked state in which the gate lock lever 463 is in the "up position", or a state in which the ignition is off. Meanwhile, "the work machine 3 is operable" is defined as a state in which the gate lock lever 463 is unlocked in the "down position", and a state in which the ignition is on. That is, when the gate lock switch 462 is off, the determination processing unit 13 determines that the gate lock lever 463 is in "up position", i.e., "the work machine 3 is inoperable". Further, when the ignition of the work machine 3 is off, the determination processing unit 13 uniformly determines that "the work machine 3 is inoperable" regardless of the state of the gate lock lever 463. In short, in the present embodiment, the determination processing unit 13 determines that the work machine 3 is inoperable when the gate lock lever 463 is locked or the ignition is off, and determines that the work machine 3 is operable when the gate lock lever 463 is unlocked and the ignition is on.

In the present embodiment, the determination processing unit 13 also determines whether or not a given condition is met with respect to the detection result of the object Ob1 around the machine body 30. That is, the determination processing unit 13 determines whether or not the detection result acquired by the acquisition processing unit 11 from the detection processing unit 14 meets the given condition.

The "given condition" here is a condition imposed on the detection result in order to perform an alarm's outputting (execute an alarm process), and includes, for example, the object Ob1 being present in the monitoring area A1 around the machine body 30. The "given condition" may include, for example, in addition to or in place of the object Ob1 being present in the monitoring area A1, the object Ob1's having a specific attribute, the object Ob1's being present in the monitoring area A1 for a given time period or more, a specific position around the machine body 30 (for example, a position in the operator's blind spot, or a position within a certain distance from the machine body 30), or the like. The "specific attribute" here includes, as an example, that the object Ob1 is operating, that the object Ob1 is a non-worker (a general person), that the object Ob1 (here, "person") is unaware of the presence of the machine body 30 by turning its back to the machine body 30, or that the given number of objects Ob1 are present. As one example in the present embodiment, the "given condition" is the object Ob1 (in this case, "person") being present in the monitoring area A1.

Further, the determination processing unit 13 outputs the determination result to at least the alarm processing unit 15. That is, to the alarm processing unit 15, the determination processing unit 13 inputs the determination result (also referred to as a first determination result) as to whether "the work machine 3 is inoperable" or "the work machine 3 is operable", and the determination result (also referred to as a second determination result) as to whether the detection result meets the given condition.

The detection processing unit 14 detects the object Ob1 in the monitoring area A1 around the machine body 30. That is, the detection processing unit 14 determines whether or not the object Ob1 is present in the monitoring area A1, and outputs the detection result showing whether or not the object Ob1 is present in the monitoring area A1. Specifically, in the present embodiment, the detection processing unit 14 regularly or irregularly acquires outputs of the left camera 341, the right camera 342 and the rear camera 343 from the left camera 341, the right camera 342 and the rear camera 343. That is, the detection processing unit 14 acquires the image data of the monitoring area A1 (each of small areas A11, A12, A13) around the work machine 3. The data acquired by the detection processing unit 14 is stored in a memory, for example. Then, the detection processing unit 14 detects the object Ob1 in the monitoring area A1, based on the outputs (image data) of the left camera 341, the right camera 342 and the rear camera 343.

Specifically, the detection processing unit 14 applies an image process to the acquired image data thereby to extract a feature quantity in the image, and based on the feature quantity, determines whether or not the object Ob1 ("person" according to the present embodiment) is reflected in the image. Here, when the object Ob1 is reflected in the image, the detection processing unit 14 determines the object Ob1 is reflected in the image captured by which of the left camera 341, the right camera 342 and the rear camera 343. That is, the detection processing unit 14 distinguishes that the object Ob1 is present in which of the small area A11 imaged by the left camera 341, the small area A12 imaged by the right camera 342, and the small area A13 imaged by the rear camera 343, thereby to detect the object Ob1.

The alarm processing unit 15 performs the alarm's outputting, that is, performs a reporting. The alarm processing unit 15 performs the alarm process that performs the alarm's outputting (reporting) which is based on the detection result of the detection processing unit 14, i.e., the detection result of the object Ob1 in the monitoring area A1 around the machine body 30. The "reporting" as used in the present disclosure means outputting the alarm to the user (operator) by various measures, including, for example, sound (including voice), display (including lighting of display light), sending to another terminal, or writing in a non-transient recording medium. However, the alarm processing unit 15 basically provides the reporting in a mode that causes the user (operator) to recognize the alarm in real time.

As a basic action thereof, the alarm processing unit 15 determines, whether or not to output the alarm, according to the determination result (second determination result) as to whether or not the detection result of the detection processing unit 14 meets the given condition.

Specifically, during the action of the work machine 3; when the detection result meets the given condition, i.e., when the object Ob1 is present in the monitoring area A1 around the machine body 30, the alarm processing unit 15 outputs the alarm. Meanwhile, during the action of the work machine 3; when the detection result fails to meet the given condition, i.e., when the object Ob1 is not present in the monitoring area A1 around the machine body 30, the alarm processing unit 15 does not output the alarm. As one example in the present embodiment, the alarm processing unit 15, when the object Ob1 is present in the monitoring area A1 around the machine body 30, causes the display unit 23 of the display device 2 to show a display to that effect, and causes the sound output unit 36 to output an alarm sound. The alarm sound may be a simple beep, or a voice such as a message "Please be careful". Further, the alarm content (display content and alarm sound) may vary according to the detection result (position of the object Ob1, distance from the machine body 30 to the object Ob1, and the like) of the detection processing unit 14.

In the present embodiment, as described above, the action mode of the alarm processing unit 15 is selected (one) from the multiple action modes including the first action mode and the second action mode. In the first action mode, the alarm processing unit 15 prohibits the alarm's outputting, when it is determined, after a first situation, that the work machine 3 is operable. Here, the first situation is defined as a situation in which the work machine 3 is determined to be inoperable, and in which the detection result meets the given condition. Meanwhile, in the second action mode, the alarm processing unit 15 outputs the alarm under the first situation, and continues the alarm's outputting when it is determined, after the first situation, that the work machine 3 is operable. Here, the first situation is defined as a situation in which the work machine 3 is determined to be inoperable, and in which the detection result meets the given condition.

Thus, in the control system 1 according to the present embodiment, the first situation is defined as a situation in which it is determined (by the determination processing unit 13) that "the work machine 3 is inoperable", and in which the detection result (of the detection processing unit 14) meets the given condition. On top of that, after at least the first situation, operating the gate lock lever 463 to the "down position" (unlocked state), for example, differentiates, between the first action mode and the second action mode, the alarm processing unit 15's action seen when the determination processing unit 13 determines that "the work machine 3 is operable". Specifically, the alarm processing unit 15, when it is determined, after the first situation, that "the work machine 3 is operable", prohibits the alarm's outputting in the first action mode, whereas continues the alarm (output under the first situation)'s outputting in the second action mode.

The term "prohibit the alarm's outputting" here means not to output the alarm (not to cause the alarm to be output). Thus, for accomplishing "prohibit the alarm's outputting" from a state in which the alarm is already being output, the alarm processing unit 15 discontinues (stops) the alarm's outputting thereby to move the process to a state in which the alarm is not output. For accomplishing "prohibit the alarm's outputting" from the state of originally avoiding the alarm's outputting (i.e., the alarm is stopped), the alarm processing unit 15 continues avoiding the alarm's outputting (i.e., the alarm is stopped).

Further, "continue to output the alarm" here means to keep the state of outputting the alarm. Thus, for accomplishing "continue to output the alarm" from a state in which the alarm is already being output, the alarm processing unit 15 continuously performs the action of outputting the alarm without discontinuing (stopping) the alarm's outputting.

[3] Work Machine Control Method

Hereinafter, an example of the work machine 3's control method (hereinafter, simply referred to as a "control method") executed mainly by the control system 1 will be described with reference to FIG. 5 to FIG. 8.

The control method according to the present embodiment is executed by the control system 1 mainly composed of the computer system, and thus, in other words, is embodied by a work machine control program (hereinafter, simply referred to as "control program"). That is, the control program according to the present embodiment is a computer program that causes one or more processors to execute each of processes related to the control method. The above control program may be cooperatively executed by, for example, the control system 1 and the display device 2.

Here, when a preset specific start operation for executing the control program is performed, the control system 1 executes the following various types of processes related to the control method. The start operation is, for example, a startup operation (ignition on) of the engine of the work machine 3. Meanwhile, when a preset specific end operation is performed, the control system 1 ends the various types of processes related to the control method. The end operation is, for example, a stop operation (ignition off) of the engine 40 of the work machine 3.

[3.1] Schematic Action

Figure 5:
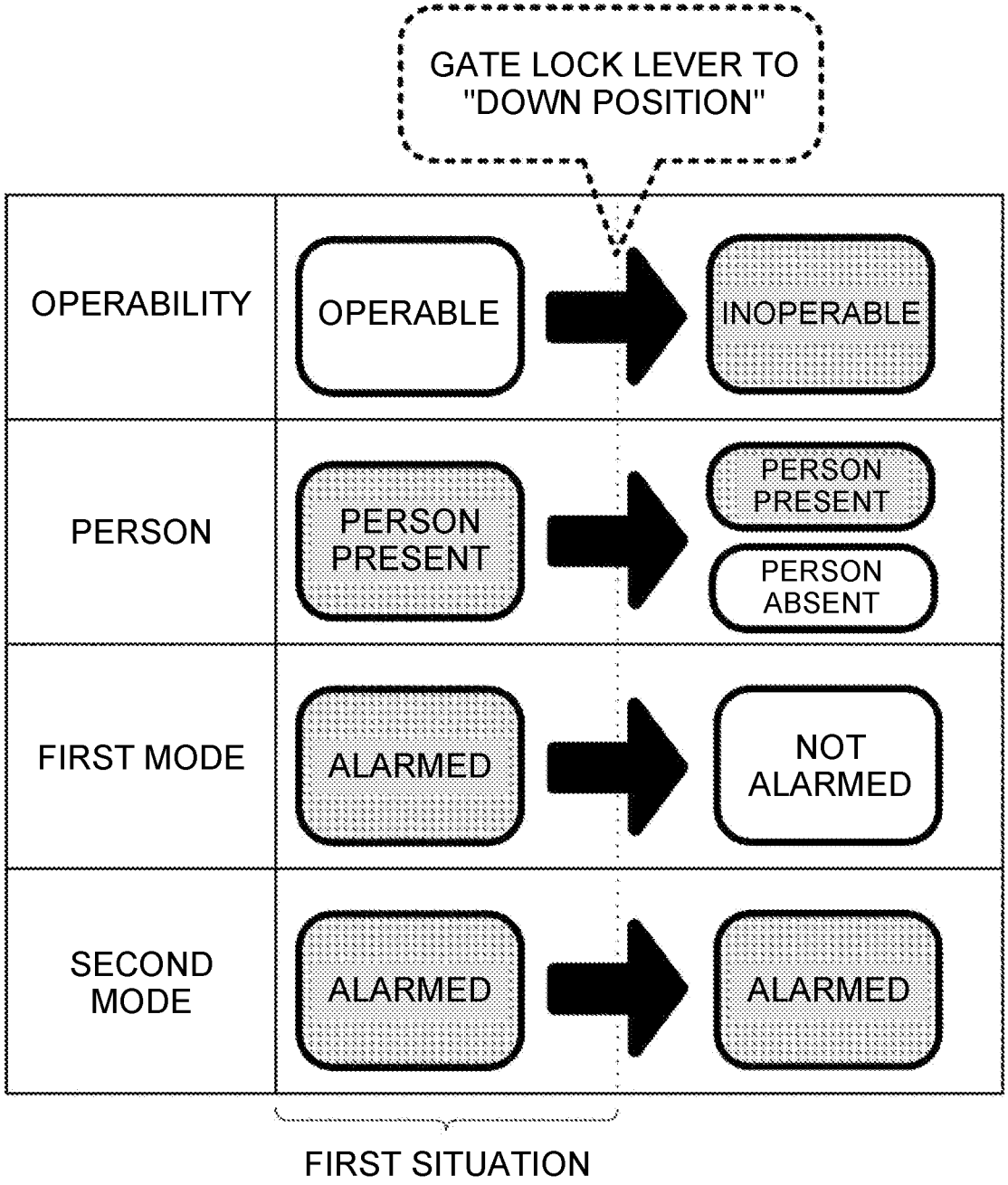
FIG. 5 is a diagram showing a schematic action of the work machine control system according to the first embodiment.

Here, first, the control method according to the present embodiment, that is, a general action of each of the first action mode and second action mode of the alarm processing unit 15 of the control system 1 according to the present embodiment will be described, with reference to FIG. 5. As shown in FIG. 5, focusing on the two items of work operability and person present/absent, it is clear that the action after the first situation is different between the first and second action modes. Here, "Work Operability" includes two states: "the work machine 3 is inoperable" (indicated as "Inoperable" in FIG. 5) and "the work machine 3 is operable" (indicated as "Operable" in FIG. 5). The "Person Present/Absent" includes two states: "the detection result meets the given condition" (indicated as "Person Present" in FIG. 5) and "the detection result fails to meet the given condition" (indicated as "Person Absent" in FIG. 5).

In the present embodiment, as described above, the "first situation" is defined as the situation in which the gate lock lever 463 is in the "up position" and thereby the work machine 3 is inoperable, and the object Ob1 is present in the monitoring area A1 around the machine body 30 and thereby the detection result meets the given state. Under the first situation, the alarm processing unit 15 of the control system 1 outputs the alarm (indicated as "Alarmed" in FIG. 5) in any of the first and second action modes. Here, in the first action mode, when it is determined, after the first situation, that the gate lock lever 463 is operated to the "down position" and thereby "the work machine 3 is operable", the alarm processing unit 15 of the control system 1 prohibits the alarm's outputting (indicated as "no alarm" in FIG. 5). Meanwhile, in the second action mode, when it is determined, after the first situation, that "the work machine 3 is operable", the alarm processing unit 15 of the control system 1 continues the alarm's outputting (indicated as "alarmed" in FIG. 5).

In short, the control method according to the present embodiment has acquiring the detection result of the object Ob1 around the machine body 30 of the work machine 3, and determining whether the work machine 3 is operable or inoperable. In this control method, the first situation is defined as the situation in which the work machine 3 is determined to be inoperable, and in which the detection result meets the given condition. And, when the alarm processing unit 15 is in the first action mode, the control method further has prohibiting the alarm's outputting when it is determined, after the first situation, that the work machine 3 is operable. Meanwhile, when the alarm processing unit 15 is in the second action mode, the control method further has outputting the alarm under the first situation, and continuing the alarm's outputting when it is determined, after the first situation, that the work machine 3 is operable.

Here, as shown in FIG. 5, when it is determined, after the first situation, that the work machine 3 is operable, the action related to the alarm's outputting is determined independently of the detection result of the detection processing unit 14. That is, there is no difference in the action related to the alarm's outputting depending on whether the detection result seen when it is determined, after the first situation, that the work machine 3 is operable meets the given condition (person present) or fails to meet the given condition (person absent). For example, in the first action mode, the alarm's outputting is prohibited in any of when the detection result seen when it is determined, after the first situation, that the work machine 3 is operable meets the given condition and when the detection result fails to meet the given condition.

[3.2] First Action Mode

Next, details of the control method according to the present embodiment which method is seen when the alarm processing unit 15 is in the first action mode, i.e., a specific action of the control system 1, are described with reference to a flowchart in FIG. 6.

As a precondition, when the gate lock lever 463 is in the "down position" and "the work machine 3 is operable", whether or not the alarm is output is determined according to the determination result (second determination result) as to whether or not the detection result of the detection processing unit 14 meets the given condition. In this state, when the detection result meets the given condition, that is, when the object Ob1 is present in the monitoring area A1 around the machine body 30, the alarm processing unit 15 outputs the alarm. Meanwhile, when the detection result fails to meet the given condition, that is, when the object Ob1 is not present in the monitoring area A1 around the machine body 30, the alarm processing unit 15 does not output the alarm. Further, in this state, the control system 1 sets, to "0" (off) as the initial value, a detection flag value prepared in the nonvolatile memory, etc.

Figure 6:
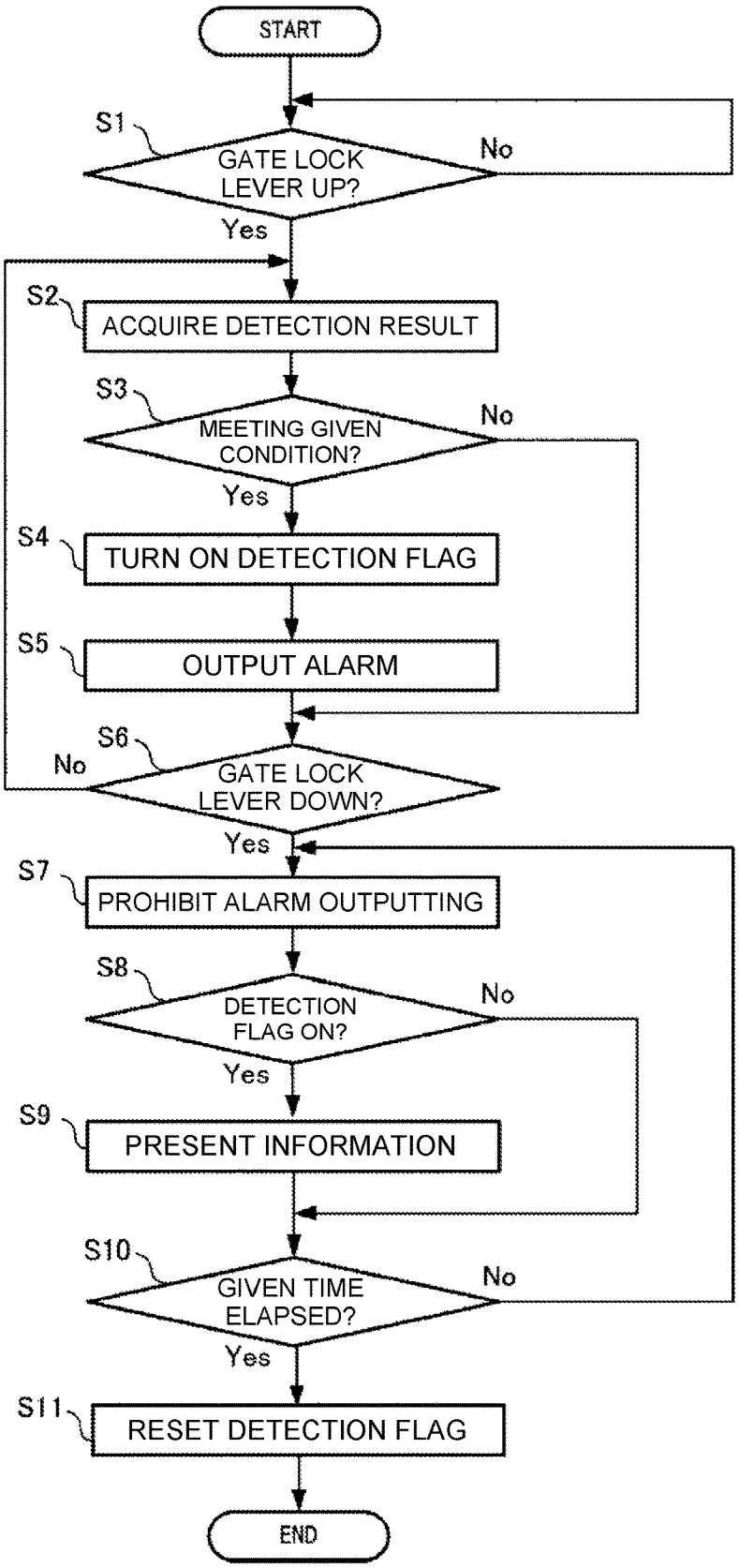
FIG. 6 is a flowchart showing an action example in a first action mode of the work machine control system according to the first embodiment.

That is, as shown in FIG. 6, when the gate lock lever 463 is operated from "down position" to "up position" as a trigger (S1: Yes), the control system 1 starts the processes from step S2 onward. Here, the determination processing unit 13 of the control system 1, by the gate lock switch 462's being on or off, determines whether the gate lock lever 463 is in "up position" or "down position", and thus determines, by the gate lock switch 462's being switched from on to off, that the gate lock lever 463 is operated to "up position" (S1: Yes). Here, when the gate lock lever 463 is brought to "up position", the gate lock switch 462 is turned off, and the first control valve 461 of the first limit unit 46 on the primary pressure side of the pilot oil path is shut off, causing "the work machine 3 is inoperable".

At step S2, from the detection processing unit 14, the acquisition processing unit 11 of the control system 1 acquires the detection result of the object Ob1 around the machine body 30. That is, based on the outputs of the left camera 341, the right camera 342 and the rear camera 343, the detection processing unit 14 outputs the detection result showing whether or not the object Ob1 is present in the monitoring area A1. The acquisition processing unit 11 acquires the detection result from the detection processing unit 14.

At step S3, the determination processing unit 13 of the control system 1 determines whether or not the detection result meets the given condition. At this time, when the object Ob1 (in this case, "person") is present in the monitoring area A1, the determination processing unit 13 determines that the detection result meets the given condition (S3: Yes), and moves the process to step S4. Meanwhile, when the object Ob1 (in this case, "person") is not present in the monitoring area A1, the determination processing unit 13 determines that the detection result fails to meet the given condition (S3: No), and moves the process to step S6.

At step S4, the determination processing unit 13 of the control system 1 sets the detection flag value to "1" (on). Here, the detection flag value of "1" (on) indicates that the object Ob1 (person) is present in the monitoring area A1, and the detection flag value of "0" (off) indicates that the object Ob1 (person) is absent from the monitoring area A1.

At step S5, the alarm processing unit 15 of the control system 1 outputs the alarm stating that the detection result of the detection processing unit 14 meets the given condition, i.e., that the object Ob1 is present in the monitoring area A1 around the machine body 30. At this time, the alarm processing unit 15 causes the display unit 23 of the display device 2 to display detection result information I1, I2 (see FIG. 8), and causes the sound output unit 36 to output the alarm sound. Thus, the operator (user U1) can recognize the object Ob1 present around the machine body 30.

That is, when it is determined that "the work machine 3 is inoperable" (S1: Yes), and when the detection result meets the given condition (S3: Yes), it is determined that the first situation is caused, thus turning on the detection flag (S4). Further, the alarm processing unit 15 of the control system 1 outputs the alarm under the first situation. As a result, in the first situation, the operator (user U1), despite the state in which the work machine 3 is inoperable, can recognize, by the alarm (at least the alarm sound from the sound output unit 36), that the object Ob1 is present around the machine body 30.

Step S6 determines whether or not the gate lock lever 463 has been operated from "up position" to "down position". At this time, the determination processing unit 13 of the control system 1 determines, by the gate lock switch 462 being on or off, whether the gate lock lever 463 is in "up position" or "down position", and thus, determines, by the gate lock switch 462 being switched from off to on, that the gate lock lever 463 is operated to "down position" (S6: Yes), and moves the process to step S7. Here, when the gate lock lever 463 is brought to "up position", the gate lock switch 462 is turned on and the first control valve 461 of the first limit unit 46 on the primary pressure side of the pilot oil path is open, causing "the work machine 3 is operable". Meanwhile, the determination processing unit 13, when determining that the gate lock lever 463 is not operated to "down position" (S6: No), moves the process to step S2.

Thus, after the first situation in which it was determined that "the work machine 3 is inoperable", "the work machine 3 is inoperable" is kept until the gate lock lever 463 is operated to the "down position" by the user (operator). In short, the determination processing unit 13 is capable of determining that the work machine 3 is operable, when at least the user operates the work machine 3 after the first situation. Thus, when it is determined, after the first situation, that the work machine 3 is operable (S6: Yes), it is deemed that the user has at least intentionally operated such that the work machine 3 is operable. In other words, without the user's intention, it is not determined, after the first situation, that "the work machine 3 is operable".

At step S7, the alarm processing unit 15 of the control system 1 prohibits the alarm's outputting. When it is determined at step S3 that the detection result meets the given condition (S3: Yes) and thereby to determine that the first situation is caused, the alarm processing unit 15, at step S7, discontinues (stops) the alarm's outputting thereby move the process to a state of not outputting the alarm. Meanwhile, when it is determined at step S3 that the detection result fails to meet the given condition (S3: No) and thereby to determine that the first situation is not caused, the alarm processing unit 15, at step S7, continues not to output the alarm (i.e., the alarm is stopped).

At step S8, the alarm processing unit 15 of the control system 1 determines whether or not the detection flag value is "1" (on). That is, when it is determined at step S3 that the detection result meets the given condition (S3: Yes) thereby to set the detection flag to on (S4), the alarm processing unit 15 determines that the detection flag value is "1" (on) (S8: Yes), and moves the process to step S9. Meanwhile, when it is determined at step S3 that the detection result fails to meet the given condition (S3: No) thereby to keep the detection flag off, the alarm processing unit 15 determines that the detection flag value is "0" (off) (S8: No), and moves the process to step S10.

At step S9, the alarm processing unit 15 of the control system 1 presents information in a mode different from the alarm output at step S5. In the present embodiment, the alarm processing unit 15, at step S5, displays the detection result information I1, I2 on the display unit 23 of the display device 2 and causes the sound output unit 36 to output the alarm sound, whereas, at step S9, only displays the detection result information I1, I2 on the display unit 23 of the display device 2. The detection result information I1, I2 displayed on the display unit 23 of the display device 2 is to be described in detail in the column "[3.4] Display Screen". That is, at step S9, at least the sound output unit 36 does not output the alarm sound. Thus, the alarm processing unit 15, when it is determined, after the first situation, that the work machine 3 is operable, presents information in the mode different from the alarm. Thus, the operator (user U1), while being able to recognize, by the information presentation (here, the display), the object Ob1 present around the machine body 30, is released from the annoyance caused by the alarm (here, the alarm sound).

At step S10, the alarm processing unit 15 of the control system 1 determines whether or not the given time has elapsed from the prohibition of the alarm's outputting (S8). The given time is the time to continue the process of inhibiting the alarm's outputting, and is set, for example, to a few seconds (3 or 5 seconds, etc.). At this time, the alarm processing unit 15 compares the elapsed time from the inhibition of the alarm's outputting (S8) with the given time; when the elapsed time has reached the given time, the alarm processing unit 15 determines that the given time has elapsed (S10: Yes), and moves the process to step S11. Meanwhile, when the elapsed time has failed to reach the given time, the alarm processing unit 15 determines that the given time has not elapsed (S10: No), and moves the process to step S7.

At step S11, the detection flag value is reset to "0" (off). That is, when the detection flag value is set to "1" (on) at step S4, the detection flag value is reset at step S11. With this, the control system 1 ends a series of actions.

The control system 1 repeatedly executes the processes from steps S1 to step S11. However, the flowchart shown in FIG. 6 is merely one example; thus, the process may be properly added or omitted, and the order of the processes may be properly replaced. For example, in place of step S10, the alarm processing unit 15, by a given operation by the user (operator), may move the process to step S11.

As described above, the control method according to the present embodiment has inhibiting the alarm's outputting when it is determined, after the first situation, that the work machine 3 is operable. Here, the first situation is a situation in which the work machine 3 is determined to be inoperable and the detection result meets the given condition. Thus, when the operator (user U1), recognizing the object Ob1 (person) being present around the work machine 3, puts the gate lock lever 463 in the unlocked state, for example, the alarm is not output despite the state in which the work machine 3 is operable. This makes it possible, for the operator, who is working carefully while paying attention to the person around the work machine 3, to prevent the deteriorated concentration due to the bothersome alarm and being distracted by the alarm. As a result, it is possible to provide the work machine control system 1, the work machine 3, the work machine 3's control method, and the work machine control program that easily reduce the operator's deteriorated concentration.

[3.3] Second Action Mode

Next, details of the control method according to the present embodiment which method is seen when the alarm processing unit 15 is in the second action mode, i.e., a specific action of the control system 1, are described with reference to a flowchart in FIG. 7.

As a precondition, when the gate lock lever 463 is in the "down position" and "the work machine 3 is operable", whether or not the alarm is output is determined according to the determination result (second determination result) as to whether or not the detection result of the detection processing unit 14 meets the given condition. In this state, when the detection result meets the given condition, that is, when the object Ob1 is present in the monitoring area A1 around the machine body 30, the alarm processing unit 15 outputs the alarm. Meanwhile, when the detection result fails to meet the given condition, that is, when the object Ob1 is not present in the monitoring area A1 around the machine body 30, the alarm processing unit 15 does not output the alarm. Further, in this state, the control system 1 sets, to "0" (off) as the initial value, a detection flag value prepared in the nonvolatile memory, etc.

Figure 7:
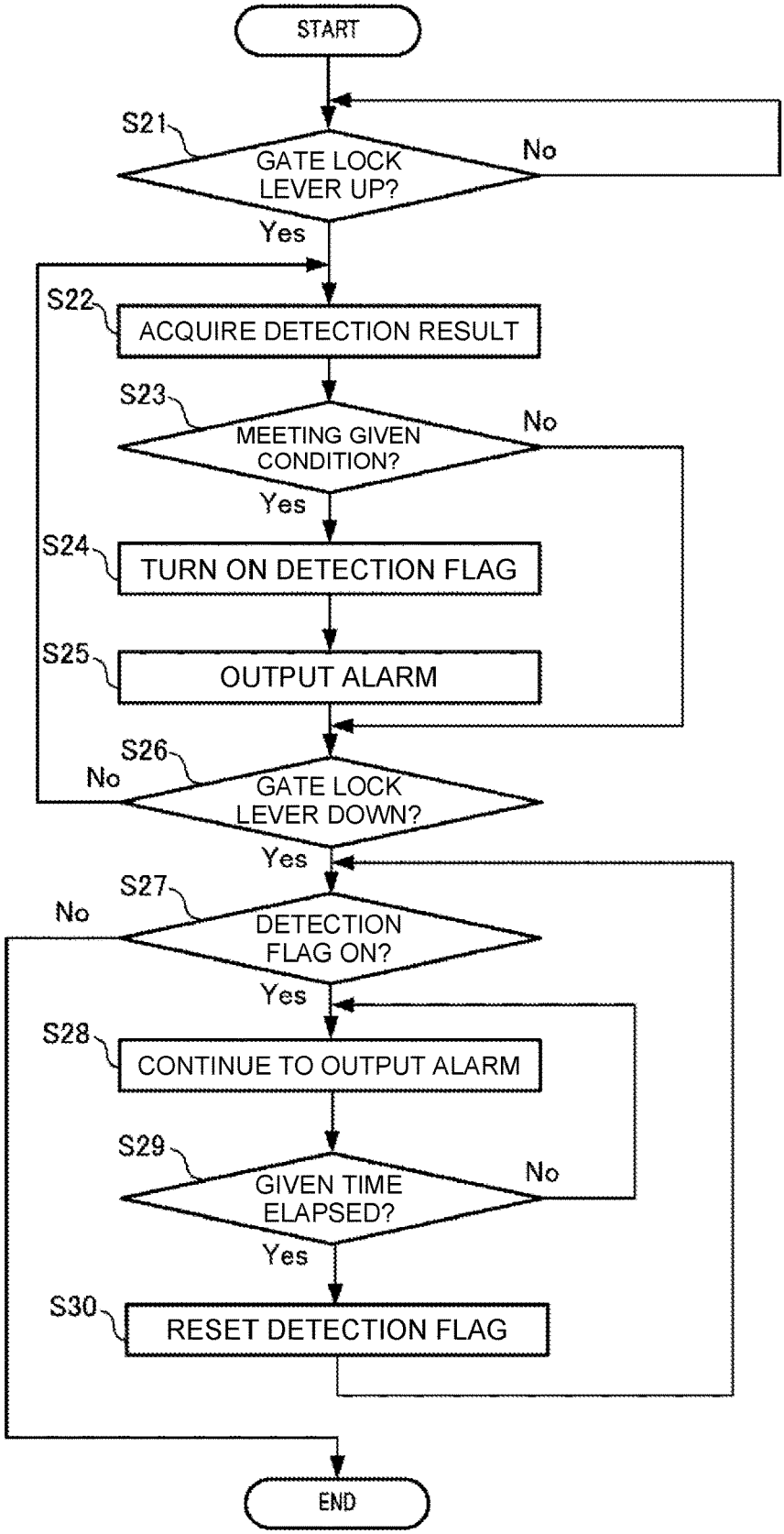
FIG. 7 is a flowchart showing an action example in a second action mode of the work machine control system according to the first embodiment.

That is, as shown in FIG. 7, when the gate lock lever 463 is operated from "down position" to "up position" as a trigger (S21: Yes), the control system 1 starts the processes from step S22 onward. Here, detailed descriptions of the processes of steps S21 to S26 are omitted because the processes of steps S21 to S26 are similar to those of steps S1 to S6 in the flowchart in FIG. 6, respectively.

That is, at step S26, the determination processing unit 13 of the control system 1 determines, with the gate lock switch 462 being switched from off to on, that the gate lock lever 463 has been operated to the "down position" (S26: Yes), and moves the process to step S27. Meanwhile, when determining that the gate lock lever 463 has not been operated to "down position" (S26: No), the determination processing unit 13 moves the process to step S22.

Thus, after the first situation in which it was determined that "the work machine 3 is inoperable", "the work machine 3 is inoperable" is kept until the gate lock lever 463 is operated to the "down position" by the user (operator). In short, the determination processing unit 13 is capable of determining that the work machine 3 is operable, when at least the user operates the work machine 3 after the first situation. Thus, when it is determined, after the first situation, that the work machine 3 is operable (S26: Yes), it is deemed that the user has at least intentionally operated such that the work machine 3 is operable. In other words, without the user's intention, it is not determined, after the first situation, that "the work machine 3 is operable".

At step S27, the alarm processing unit 15 of the control system 1 determines whether or not the detection flag value is "1" (on). That is, when it is determined at step S23 that the detection result meets the given condition (S23: Yes) thereby to set the detection flag set to "on" (S24), the alarm processing unit 15 determines that the detection flag value is "1" (on) (S27: Yes), and moves the process to step S28. Meanwhile, when it is determined at step S23 that the detection result fails to meet the given condition (S23: No) thereby to keep the detection flag off, the alarm processing unit 15 determines that the detection flag value is "0" (off) (S27: Yes), and the control system 1 ends the series of actions.

At step S28, the alarm processing unit 15 of the control system 1 continues the alarm's outputting. That is, when it is determined at step S23 that the detection result meets the given condition (S23: Yes) thereby to determine that the first situation is caused, the alarm processing unit 15, at step S28, continues the action of outputting the alarm. Meanwhile, when it is determined at step S23 that the detection result fails to meet the given condition (S23: No) thereby to determine that the first situation is not caused, the detection flag value is determined to be "0" (off) (S27: Yes), and thus the process of continuing the alarm's outputting is not executed.

At step S29, the alarm processing unit 15 of the control system 1 determines whether or not the given time has elapsed from the continuing of the alarm's outputting (S28). The given time is the time to continue the alarm's outputting, and is set, for example, to a few seconds (3 or 5 seconds, etc.). At this time, the alarm processing unit 15 compares the elapsed time from the continuing of the alarm's outputting (S28) with the given time; when the elapsed time has reached the given time, the alarm processing unit 15 determines that the given time has elapsed (S29: Yes), and moves the process to step S30. Meanwhile, when the elapsed time has failed to reach the given time, the alarm processing unit 15 determines that the given time has not elapsed (S29: No), and moves the process to step S28.

At step S30, the detection flag value is reset to "0" (off). That is, when the detection flag value is set to "1" (on) at step S24, the detection flag value is reset at step S30. Then, the control system 1 moves the process to step S27.

The control system 1 repeatedly executes the processes at step S21 to step S30. However, the flowchart shown in FIG. 7 is merely one example; thus, the process may be properly added or omitted, and the order of the processes may be properly replaced. For example, in place of step S29, the alarm processing unit 15 may, by a given operation by the user (operator), move the process to step S30.

As described above, the control method according to the present embodiment has outputting the alarm under the first situation, and continuing the alarm's outputting when it is determined, after the first situation, that the work machine 3 is operable. Here, the first situation is a situation in which the work machine 3 is determined to be inoperable and the detection result meets the given condition. Thus, for example, it is easy to prevent the operator (user U1), without recognizing the person present around the work machine 3, from putting the gate lock lever 463 in the unlocked state and moving to the state in which the work machine 3 is operable. Thus, for example, the level of carefulness required of the operator for avoiding the sudden and vigorous action of the work machine 3 can be reduced. As a result, it is possible to provide the work machine control system 1, the work machine 3, the work machine 3's control method, and the work machine control program that easily reduce the operator's burden related to the operation.

By the way, in the present embodiment, at least when the alarm processing unit 15 is in the second action mode, the alarm is output not only under the first situation but also under the second situation as under the first situation. Here, the second situation is a situation in which the work machine 3 is determined to be operable, and in which the detection result meets the given condition. That is, the alarm processing unit 15, when the second situation is defined as the situation in which the work machine 3 is determined to be operable, and in which the detection result meets the given condition, outputs the alarm even under the second situation. With this, the alarm processing unit 15, even when "the work machine 3 is operable", if the object Ob1 is present in the monitoring area A1 around the machine body 30, outputs the alarm, making it possible to inform the user (operator) thereof.

Further, the alarm processing unit 15 continues the alarm's outputting even when it is determined, after the second situation, that the work machine 3 is inoperable. That is, like the case in which it is determined, after the first situation, that "the work machine 3 is inoperable", the alarm processing unit 15 continues the alarm's outputting when it is determined, after the second situation, that "the work machine 3 is inoperable". Thus, when the object Ob1 is present in the monitoring area A1 around the machine body 30, for example, it is possible for the alarm processing unit 15 to output the alarm and to inform the user (operator) thereof.

Here, in the present embodiment; not only when the alarm processing unit 15 is in the second action mode, but also in the first action mode, the alarm processing unit 15, under the second situation, outputs the alarm in the same mode as under the first situation. When the alarm processing unit 15 is in the first action mode, the alarm processing unit 15, when it is determined, after the second situation, that the work machine 3 is inoperable, continues the alarm's outputting.

[3.4] Display Screen

Next, the configuration of the display screen Dp1 displayed on the display unit 23 of the display device 2 by the control method according to the present embodiment will be described with reference to FIG. 8. In the drawings showing the display screen Dp1 displayed on the display unit 23 of the display device 2, such as FIG. 8, a dashed-dotted line showing a region, a leading line, and a reference sign are each merely for an illustrative purpose, and may not be actually displayed at the display device 2.

Figure 8:
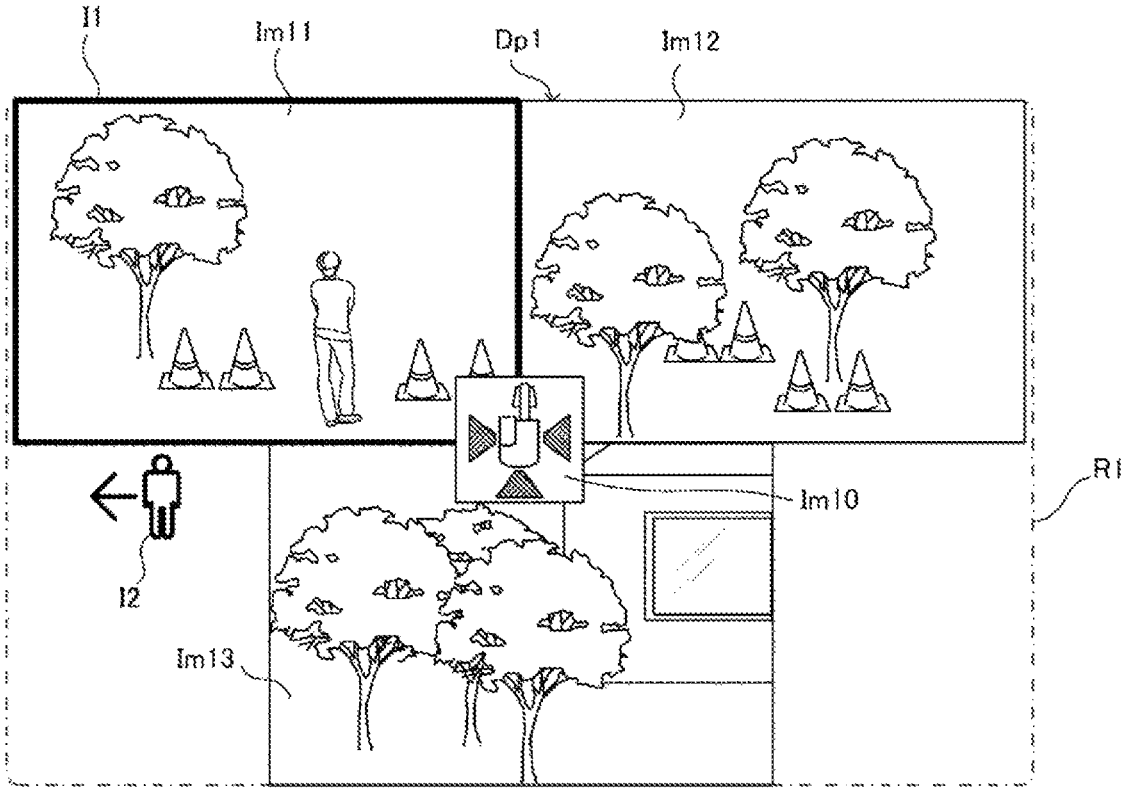
FIG. 8 is a diagram showing an example of the display screen displayed by the work machine control system according to the first embodiment.

As shown in FIG. 8, the display screen Dp1 displays captured images Im11, Im12, Im13 of the monitoring area A1, and detection result information I1, I2 and the like showing the detection result of the detection processing unit 14. FIG. 8 shows, of the display screen Dp1, only a region R1 displaying the captured images Im11, Im12, Im13 and the like of the monitoring area A1, and omits any region other than the region R1. The captured image Im11 is an image of the small area A11 that is captured by the left camera 341 and that is on the left of the drive unit 321, and the captured image Im12 is an image of the small area A12 that is captured by the right camera 342 and that is on the right of the drive unit 321. The captured image Im13 is an image of the small area A13 that is captured by the rear camera 343 and that is behind the drive unit 321.

The control system 1 causes the captured images Im11, Im12, Im13, which are acquired by the detection processing unit 14, to be displayed in real time. An icon Im10, which imitates the machine body 30 as seen from the information, is displayed in the center portion of the region R1. The icon Im10 schematically shows the positional relation of imaging ranges (small areas A11, A12, and A13) of the left camera 341, right camera 342 and rear camera 343, as seen from the machine body 30.

The detection result information I1 is, of the captured images Im11, Im12, Im13, a band-shaped (frame-shaped) graphical image that highlights the captured image including the object Ob1. The detection result information I2 is a graphical image showing the direction in which the object Ob1 is present viewed from the drive unit 321. The example in FIG. 8 assumes a case where the object Ob1 (here, "person") is present in the small area A11 that is captured by the left camera 341 and that is on the left of the drive unit 321. Thus, of the captured images Im11, Im12, Im13, the captured image Im11 is highlighted in the detection result information I1; and the detection result information I2 showing the object Ob1 present on the left of the drive unit 321 is displayed below the captured image Im11.

The display mode of the detection result information I1, I2 is preferably changed according to the object Ob1's position in the monitoring area A1. For example, the detection result information I1, I2's display mode, such as display color, size, or display pattern (including blinking pattern and the like), is changed according to the object Ob1's position in the monitoring area A1. For example, the closer the object Ob1 is to the machine body 30, the display color is changed to a more prominent display mode of the detection result information I1, I2; as an example, the object Ob1 approaching the machine body 30 changes the display color of the detection result information I1, I2 from yellow to red.

Thus, the display screen Dp1 not only displays the captured images Im11, Im12, Im13 of the monitoring area A1, but also displays, as the detection result information I1, I2, the detection result of the object Ob1 in the monitoring area A1. Thus, the operator (user U1), by viewing the display screen Dp1, can easily check whether or not the object Ob1 is present in the monitoring area A1. Thus, on the display screen Dp1 displayed on the display device 2, the operator (user U1) can check the situations at the work machine 3's sides and rear which are likely to be blind spots from the drive unit 321. Thus, compared to the configuration in which only the detection result information I1, I2 are displayed; when the object Ob1 is present in the monitoring area A1, it is easier to grasp in detail, on the display screen Dp1, the situation of the object Ob1.

[4] Modified Examples

A description will hereinafter be made on modified examples of the first embodiment. The modified examples, which will be described below, can be applied in proper combination.

The control system 1 according to the present disclosure includes the computer system. The computer system has, as hardware, one or more processors and one or more storages. The processor, by executing the program recorded in the storage of the computer system, realizes the function as the control system 1 in the present disclosure. The program may be preliminarily recorded in the storage of the computer system, may be provided through an electric communication line, or may be provided in a manner to be recorded in a non-transitory recording medium, such as a memory card, an optical disk, a hard disk drive, or the like, each of which is readable by the computer system. Further, part of or all of the functional units included in the control system 1 may be composed of an electronic circuit.

Further, collecting at least part of the functions of the control system 1 in one case is not an essential configuration for the control system 1, and the components of the control system 1 may be provided in a multiplicity of cases in a distributed manner. Conversely, in the first embodiment, functions that are distributed to a multiplicity of devices (such as the control system 1 and the display device 2) may be collected in one case. Further, at least part of the functions of the control system 1 may be realized by a cloud (cloud computing) or the like.

Further, the power source of the work machine 3 is not limited to the diesel engine, but may be, for example, the engine 40 other than the diesel engine, a motor (an electric motor), or a hybrid power source that includes the engine 40 and the motor (electric motor).

Further, the display device 2 is not limited to a dedicated device, but may be a general-purpose terminal such as a laptop computer, a tablet terminal, or a smartphone. Further, the display unit 23 is not limited to a mode that directly displays a display screen, such as a liquid crystal display or an organic EL display, but may be a configuration that displays the display screen by projection, such as a projector.

Further, as a mode for inputting information of the operation unit 22, a mode other than the push button switch, the touch screen, and the operation dial may be employed. For example, the operation unit 22 may employ any mode such as a keyboard, a pointing device such as mouse, a voice input, a gesture input, or inputting an operation signal from another terminal.

Further, the output mode of the alarm in the alarm processing unit 15 is not limited to display on the display unit 23 of the display device 2 and the alarm sound's outputting from the sound output unit 36. For example, the alarm processing unit 15 may output the alarm by any one of the display on the display unit 23 of the display device 2 or the alarm sound from the sound output unit 36, or by other means such as vibration (vibration function), sending to another terminal or writing in the non-transient recording medium, or a combination of the above. In the above cases as well, it is preferable that the alarm processing unit 15, when it is determined, after the first situation, that the work machine 3 is operable, presents information in a mode different from the alarm.

Further, the sensors for detecting the object Ob1 in the monitoring area A1 around the machine body 30 are not limited to the left camera 341, the right camera 342 and the rear camera 343, and may include one, two, or four or more cameras (image sensors). Further, for example, a camera that can capture images in all directions as seen from the work machine 3, such as a 360-degree camera, may be used to detect the object Ob1 in the monitoring area A1. Further, the sensors for detecting the object Ob1 in the monitoring area A1 may include, in addition to or in place of the camera, an action sensor, a sonar sensor, a radar, or LiDAR (Light Detection and Ranging), for example. Here, the sensor that detects the object Ob1 in the monitoring area A1 may be a 3D sensor that measures the distance to object Ob1, by the TOF (Time Of Flight) method that measures the distance to the distance measurement point based on the round trip time for light or sound to reach the distance measurement point and return.

Further, the detection processing unit 14, which detects the object Ob1 around the machine body 30, is not the configuration essential for the control system 1. For example, the detection processing unit 14 may be included in a detection system other than the control system 1; in this case, the acquisition processing unit 11 of the control system 1 acquires, from outside (detection system) of the control system 1, the detection result of the object Ob1 around the machine body 30 of the work machine 3.

Further, the object Ob1 may include, in addition to or in place of a "person", a mobile object such as a vehicle (including other work machine), structures such as walls and pillars, plants, animals, steps, ditches, or other obstacles.

Further, the actuator of each portion of the machine body 30 is not limited to the hydraulic actuator, but may be, for example, a pneumatic actuator driven by compressed air or other air pressure, or an electric actuator driven by an electric power supply, or a combination thereof.

Further, switching of the action mode of the alarm processing unit 15 is not a function essential for the control system 1, and the switch processing unit 12 can be omitted as proper. That is, the alarm processing unit 15 may be so configured as to move in only any one of the first action mode and the second action mode. Further, the alarm processing unit 15 may have another action mode in addition to the first and second action modes or in place of at least one of them. As an example of the other action mode, the alarm processing unit 15 may have a third action mode that does not output the alarm under the first situation, and outputs the alarm when it is determined, after the first situation, that the work machine 3 is operable. Further, the alarm processing unit 15 may have a fourth action mode that outputs the alarm, always based only on the second determination result (determination result as to whether the detection result meets the given condition), regardless of the first determination result (determination result as to whether "the work machine 3 is inoperable" or "the work machine 3 is operable"). Further, the alarm processing unit 15 may have a fifth action mode that always prohibits the alarm's outputting, regardless of the first and second determination results.

Further, it is not a configuration essential for the control system 1 that the given condition includes the object Ob1 being present in the monitoring area A1 around the work machine 3. Further, it is not essential that the alarm processing unit 15, in the first action mode, outputs the alarm under the first situation. Further, it is not essential that the determination processing unit 13 determines, when the gate lock lever 463 of the work machine 3 is locked or the ignition of the work machine 3 is off, that the work machine 3 is inoperable. Similarly, it is not essential that the determination processing unit 13 determines, when the gate lock lever 463 is unlocked and the ignition is on, that the work machine 3 is operable. Further, it is not essential that the alarm processing unit 15, in the first action mode, when it is determined, after the first situation, that the work machine 3 is operable, presents information in the mode different from the alarm. Further, it is not essential that the determination processing unit 13 is capable of determining that the work machine 3 is operable, when at least the user operates the work machine 3 after the first situation.

Further, it is not an essential configuration that the alarm processing unit 15, in the second action mode, when the second situation is defined as the situation in which the work machine 3 is determined to be operable, and in which the detection result meets the given condition, outputs the alarm even under the second situation. Further, it is not an essential configuration that the alarm processing unit 15, in the second action mode, continues the alarm's outputting when it is determined, after the second situation, that the work machine 3 is inoperable.

Second Embodiment

Figure 9:
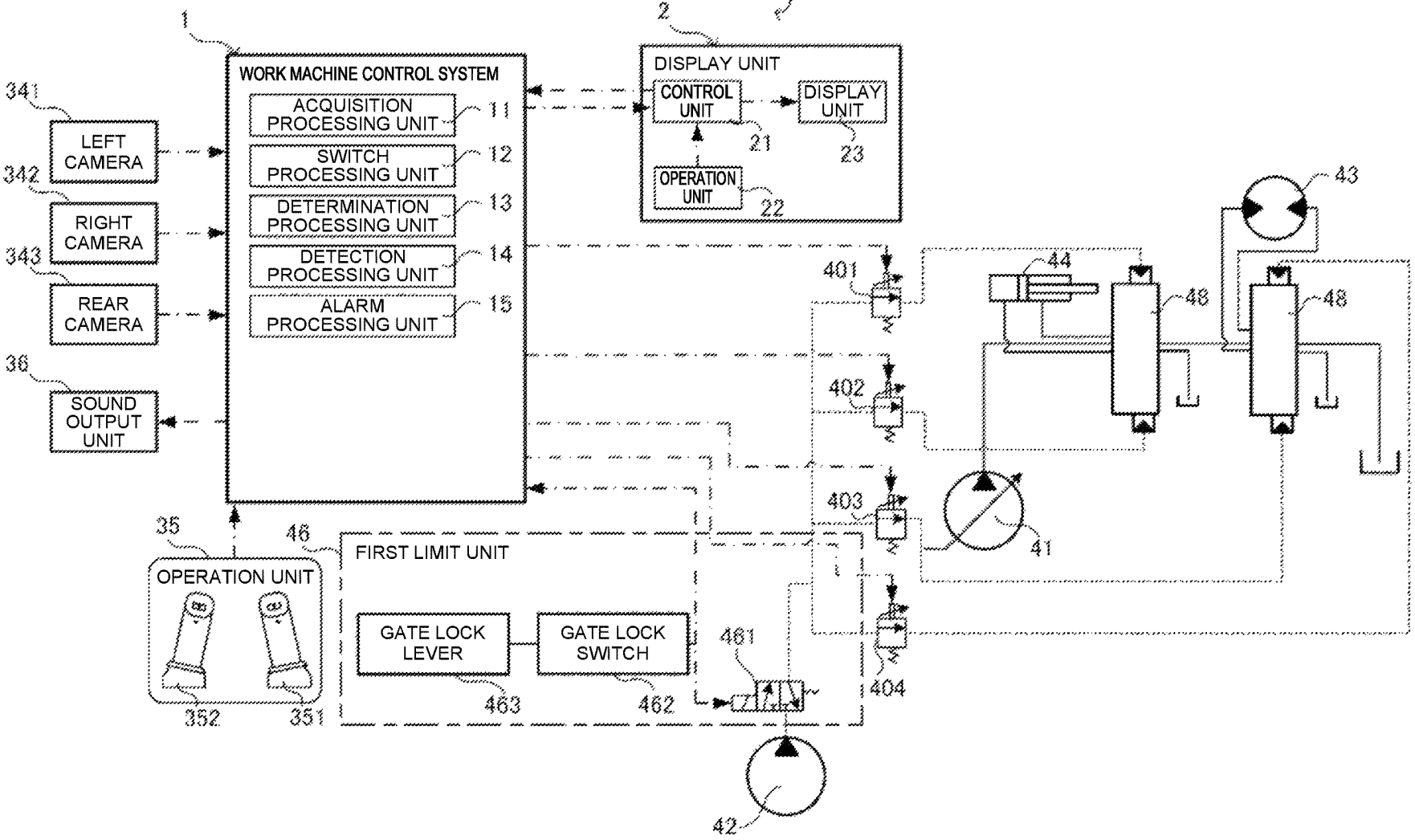
FIG. 9 is a schematic view showing a hydraulic circuit and the like of the work machine according to a second embodiment.

The work machine 3, as shown in FIG. 9, differs from the work machine 3 according to the first embodiment in the configuration related to the operation of the operation unit 35. Hereinafter, the same configurations as those in the first embodiment will be denoted by the same reference signs, and the description thereof will be properly omitted.

FIG. 9 schematically shows a hydraulic circuit and electric circuit (electric connection) of the work machine 3 according to the present embodiment. In FIG. 9, a solid line shows a high-pressure oil path (for hydraulic oil), a dotted line shows a low-pressure oil path (for pilot oil), and a dashed-dotted line arrow shows an electric signal path.

As shown in FIG. 9, the work machine 3 includes a multiplicity of control valves 401 to 404, in addition to the hydraulic pump 41, the hydraulic motor 43, the hydraulic cylinder 44, the pilot pump 42, the direction switch valve (control valve) 48 and the like. Further, FIG. 9 properly omits the flowrate limit unit 49 and the like. In FIG. 9, only one hydraulic cylinder 44 for driving the boom 332 is shown; however, the same hydraulic circuit is configured also for the hydraulic cylinder 44 for driving the arm 333 or the bucket 331, etc. Further, in FIG. 9, only the hydraulic motor 43 of the run unit 31 is shown, but the same hydraulic circuit is configured also for the hydraulic motor of the swing unit 32.

The multiplicity of control valves 401 to 404 replaces the second control valve 471 and the remote control valve 45 (see FIG. 2) each as the second limit unit 47. Specifically, the control valves 401 to 404 are provided on the pilot oil's supply paths to the respective direction switch valves 48. Further, the pilot oil's upstream viewed from the control valves 401 to 404 is provided with the first control valve 461. The control valves 401 to 404 are each a solenoid control valve (electromagnetic valve), and are inserted to between the direction switch valve 48 and the pilot pump 42, respectively. Each of the control valves 401 to 404 is connected to the control system 1, and moves according to the control signal (supply current) from the control system 1. Specifically, the control system 1 controls the control valves 401 to 404 according to the operation of the operation unit 35 (operation lever), and directs, for example, the deployment and reduction actions of the work unit 33. Each of the control valves 401 to 404 is here assumed to be a (solenoid type) proportional control valve, but can also be, a switchable open/close valve that opens/shuts off the flow path, for example.

The above direction switch valve and control valve are provided not only for the hydraulic circuits of the hydraulic cylinder 44 for driving the boom 332 and the hydraulic motor 43 of the run unit 31, but also for the hydraulic circuits of the hydraulic cylinders 44 for driving the arm 333 or bucket 331 and the hydraulic motor of the swing unit 32. Thus, according to the operation unit 35's operation, the run unit 31, the swing unit 32, and the work unit 33 can be moved.

In the present embodiment, the operation unit 35 is an electric operation unit 35, and outputs, to the control system 1, the electric signal (operation signal) that accords to the user (operator)'s operation, thereby to receive various operations by the user. As one example in the present embodiment, the operation unit 35 includes a pair of operation levers 351 and 352 (see FIG. 9). The operation lever 351 is positioned on the right hand side as viewed from the user (operator) boarding the drive unit 321, and the operation lever 352 is positioned on the left hand side as viewed from the user boarding the drive unit 321. Thus, the user holds the operation lever 351 with the right hand and the operation lever 352 with the left hand, for example, and separately operates the pair of operation levers 351 and 352 thereby to cause the work machine 3 to perform various actions.

The operation levers 351 and 352 are stick-type operants, respectively, and are operated to tilt to any of "front", "rear", "left", and "right", for example, thereby to output the electric signal (operation signal) that accords to the operation. The operation unit 35, as an example, outputs different operation signals, corresponding respectively to an operation to tilt the operation lever 351 to the front, an operation to tilt the operation lever 351 to the right, an operation to tilt the operation lever 352 to the front, and an operation to tilt the operation lever 352 to the right.

In this configuration, the action (control method) of the control system 1 is the same as in the first embodiment. The configuration according to the second embodiment can be employed in proper combination with the various configurations (including modifications) described in the first embodiment.

REFERENCE SIGNS LIST

1: work machine control system
3: work machine
11: acquisition processing unit
13: determination processing unit
15: alarm processing unit
30: machine body
463: gate lock lever
A1: monitoring area
Ob1: object
U1: user

The invention claimed is:

1. A work machine control system comprising:
an acquisition processing unit that acquires a detection result of an object around a machine body of a work machine;
a determination processing unit that determines whether the work machine is operable or inoperable; and
an alarm processing unit that outputs an alarm,
wherein
the alarm processing unit, in a first situation defined as a situation in which the work machine is determined to be inoperable and in which the detection result meets a given condition,
prohibits the alarm's outputting when it is determined, after the first situation, that the work machine is operable.

2. The work machine control system according to claim 1, wherein
the given condition includes the object being present in a monitored area around the work machine.

3. The work machine control system according to claim 1, wherein
the alarm processing unit performs the alarm's outputting under the first situation.

4. The work machine control system according to claim 1, wherein
the determination processing unit determines, when a gate lock lever of the work machine is locked or an ignition of the work machine is off, that the work machine is inoperable, and determines, when the gate lock lever is unlocked and the ignition is on, that the work machine is operable.

5. The work machine control system according to claim 1, wherein the alarm processing unit, when it is determined, after the first situation, that the work machine is operable, presents information in a mode different from the alarm.

6. The work machine control system according to claim 1, wherein the determination processing unit is capable of determining that the work machine is operable, when at least a user operates the work machine after the first situation.

7. A work machine, comprising:

the work machine control system according to claim 1; and the machine body.

8. A work machine control method comprising:

acquiring a detection result of an object around a machine body of a work machine;

determining whether the work machine is operable or inoperable; and in a first situation defined as a situation in which the work machine is determined to be inoperable and in which the detection result meets a given condition, prohibiting the alarm's outputting when it is determined, after the first situation, that the work machine is operable.

9. A work machine control program for causing one or more processors to execute the work machine control method according to claim 8.

10. A work machine control system comprising:

an acquisition processing unit that acquires a detection result of an object around a machine body of a work machine;

a determination processing unit that determines whether the work machine is operable or inoperable; and an alarm processing unit that outputs an alarm, wherein the alarm processing unit, in a first situation defined as a situation in which the work machine is determined to be inoperable and in which the detection result meets a given condition, outputs the alarm under the first situation, and continues the alarm's outputting when it is determined, after the first situation, that the work machine is operable.

11. The work machine control system according to claim 10, wherein the given condition includes the object being present in a monitored area around the work machine.

12. The work machine control system according to claim 10, wherein the determination processing unit determines, when a gate lock lever of the work machine is locked or an ignition of the work machine is off, that the work machine is inoperable, and determines, when the gate lock lever is unlocked and the ignition is on, that the work machine is operable.

13. The work machine control system according to claim 10, wherein the alarm processing unit, in a second situation defined as a situation in which the work machine is determined to be operable and in which the detection result meets the given condition, outputs the alarm even under the second situation.

14. The work machine control system according to claim 13, wherein the alarm processing unit continues the alarm's outputting when it is determined, after the second situation, that the work machine is inoperable.

15. The work machine control system according to claim 10, wherein the determination processing unit is capable of determining that the work machine is operable, when at least a user operates the work machine after the first situation.

16. A work machine, comprising:

the work machine control system according to claim 10; and the machine body.

17. A work machine control method comprising:

acquiring a detection result of an object around a machine body of a work machine;

determining whether the work machine is operable or inoperable; and in a first situation defined as a situation in which the work machine is determined to be inoperable and in which the detection result meets a given condition, outputting an alarm under the first situation, and continuing the alarm's outputting when it is determined, after the first situation, that the work machine is operable.

18. A work machine control program for causing one or more processors to execute the work machine control method according to claim 17.

* * * * *